US008082926B2

(12) United States Patent
Yano et al.

(10) Patent No.: US 8,082,926 B2
(45) Date of Patent: Dec. 27, 2011

(54) LIP CATEGORIZING METHOD, MAKEUP METHOD, CATEGORIZING MAP, AND MAKEUP TOOL

(75) Inventors: Hiroko Yano, Tokyo (JP); Hirofumi Kera, Tokyo (JP); Wakae Matsuyama, Tokyo (JP); Kumiko Kuroki, Tokyo (JP); Miki Ishida, Tokyo (JP); Yuko Sasaki, Tokyo (JP); Miyako Okamoto, Tokyo (JP); Yasuo Goto, Tokyo (JP); Yoshiko Masushio, Tokyo (JP); Etsu Nishijima, Tokyo (JP)

(73) Assignee: Shiseido Co., Ltd., Chuo-ku, Tokyo (JP)

( * ) Notice: Subject to any disclaimer, the term of this patent is extended or adjusted under 35 U.S.C. 154(b) by 667 days.

(21) Appl. No.: 11/665,687

(22) PCT Filed: Oct. 25, 2005

(86) PCT No.: PCT/JP2005/019330

§ 371 (c)(1),
(2), (4) Date: Dec. 30, 2008

(87) PCT Pub. No.: WO2006/043643

PCT Pub. Date: Apr. 27, 2006

(65) Prior Publication Data

US 2009/0139536 A1 Jun. 4, 2009

(30) Foreign Application Priority Data

Oct. 22, 2004 (JP) ..... 2004-308670
Oct. 22, 2004 (JP) ..... 2004-308671
Oct. 6, 2005 (JP) ..... 2005-293925

(51) Int. Cl.

| | |
|---|---|
| ***A45D 24/00*** | (2006.01) |
| ***A45D 7/00*** | (2006.01) |
| ***A45D 44/00*** | (2006.01) |
| ***G06K 9/00*** | (2006.01) |

(52) U.S. Cl. ..... 132/200; 132/333; 382/100

(58) Field of Classification Search ..... 132/200, 132/319, 333; 434/98, 99, 100; 382/100, 382/118, 154, 274; 340/5.53, 5.83
See application file for complete search history.

(56) References Cited

U.S. PATENT DOCUMENTS 2,746,463 A 5/1956 Stuart
(Continued)

FOREIGN PATENT DOCUMENTS

EP 0828230 A2 3/1998
(Continued)

OTHER PUBLICATIONS

Supplementary European Search Report for Application No. 05795882 mailed Mar. 11, 2009, six pages.

(Continued)

*Primary Examiner* — Todd Manahan
*Assistant Examiner* — Vanitha Elgart
(74) *Attorney, Agent, or Firm* — Rankin, Hill & Clark LLP

(57) ABSTRACT

A lip categorizing method uses the size and shape of the lips as viewed from the front of the face as a first categorization index and the three-dimensional form of the lips as a second categorization index. The lip categorizing map is composed of a first coordinate axis showing the degree of the first categorization index and a second coordinate axis showing the degree of the second categorization index and has a coordinate system in which the first and second coordinate axes are orthogonal. It also generates makeup information for two-dimensionally correcting the lips of a subject based on preset reference by setting a plurality of points for determining the form features of lips on an image that depicts the lips, and judges the form features of the lips of the subject based on analytical values of the two-dimensional features of the lips measured from the set points.

13 Claims, 31 Drawing Sheets

U.S. PATENT DOCUMENTS

| | | | | |
|---|---|---|---|---|
| 2,931,369 | A | 4/1960 | Badovinac | |
| 3,805,238 | A * | 4/1974 | Rothfjell | 382/118 |
| 4,975,969 | A * | 12/1990 | Tal | 382/116 |
| 5,805,745 | A * | 9/1998 | Graf | 382/291 |
| 5,850,463 | A * | 12/1998 | Horii | 382/118 |
| 5,933,527 | A * | 8/1999 | Ishikawa | 382/190 |
| 6,067,378 | A * | 5/2000 | Lee | 382/203 |
| 6,091,836 | A * | 7/2000 | Takano et al. | 382/118 |
| 6,219,639 | B1 * | 4/2001 | Bakis et al. | 704/246 |
| 6,293,284 | B1 * | 9/2001 | Rigg | 132/200 |
| 6,502,583 | B1 * | 1/2003 | Utsugi | 132/200 |
| 6,690,815 | B2 * | 2/2004 | Mihara et al. | 382/118 |
| 6,810,130 | B1 * | 10/2004 | Aubert et al. | 382/100 |
| 6,937,755 | B2 * | 8/2005 | Orpaz et al. | 382/162 |
| 7,187,787 | B2 * | 3/2007 | Milne et al. | 382/118 |
| 7,392,204 | B1 * | 6/2008 | Matsumoto et al. | 705/7.32 |
| 7,551,755 | B1 * | 6/2009 | Steinberg et al. | 382/118 |
| 7,587,068 | B1 * | 9/2009 | Steinberg et al. | 382/118 |
| 7,634,103 | B2 * | 12/2009 | Rubinstenn et al. | 382/100 |
| 7,643,683 | B2 * | 1/2010 | Miller | 382/190 |
| 7,646,880 | B2 * | 1/2010 | Kamada et al. | 382/100 |
| 7,835,549 | B2 * | 11/2010 | Kitamura et al. | 382/118 |
| 7,848,547 | B2 * | 12/2010 | Takeguchi et al. | 382/118 |
| 2002/0122573 | A1 * | 9/2002 | Eraslan | 382/118 |
| 2003/0015214 | A1 | 1/2003 | Faragi | |
| 2003/0108225 | A1 * | 6/2003 | Li | 382/118 |
| 2005/0207654 | A1 * | 9/2005 | Rodyushkin et al. | 382/217 |
| 2007/0047761 | A1 * | 3/2007 | Wasilunas et al. | 382/100 |
| 2007/0047775 | A1 * | 3/2007 | Okubo | 382/118 |
| 2008/0080746 | A1 * | 4/2008 | Payonk et al. | 382/118 |
| 2009/0141950 | A1 * | 6/2009 | Ryu | 382/118 |
| 2010/0142755 | A1 * | 6/2010 | Brandewie et al. | 382/100 |
| 2010/0220933 | A1 * | 9/2010 | Takano et al. | 382/224 |
| 2010/0252061 | A1 * | 10/2010 | Samain et al. | 132/200 |

FOREIGN PATENT DOCUMENTS

| | | |
|---|---|---|
| EP | 1226770 | 7/2002 |
| FR | 752860 | 10/1933 |
| JP | 7-24213 | 5/1995 |
| JP | 8-202754 | 8/1996 |
| JP | 8-206099 | 8/1996 |
| JP | 10-23922 | 1/1998 |
| JP | 10-75823 | 3/1998 |
| JP | 2986214 | 10/1999 |
| JP | 2000-11143 | 1/2000 |
| JP | 2001-346627 | 12/2001 |
| JP | 3423311 | 4/2003 |
| JP | 3529954 | 3/2004 |
| JP | 2005-74105 | 3/2005 |
| WO | WO 93/02179 | 11/1993 |

OTHER PUBLICATIONS

Translation of related part of JP Publication No. 7-24213, two pages.
European Search Report for corresponding EP 10004658 completed Jul. 14, 2010, five pages.

* cited by examiner

Excessively high

Excessively flat

LIP CATEGORIZING METHOD, MAKEUP METHOD, CATEGORIZING MAP, AND MAKEUP TOOL

TECHNICAL FIELD

The present invention relates to a method for categorizing lips according to their form features, a lip categorizing map composed of coordinates generated based on this categorizing method, a lip makeup method for making up the lips according to the shape of the lips, and a tool for making up the lips. This lip categorizing method and categorizing map can be used as a method for making up lips, for providing aesthetic counseling to customers or for instructing beauty consultants or beauticians and so on, and allows the application of makeup to the lips to be judged both preferable and attractive corresponding to the formal features of the lips.

BACKGROUND ART

In the past, categorization of facial features, methods for making up the eyes, or methods for selecting foundations that reproduce natural skin color have been proposed for the purpose of advantageously using in beauty methods. For example, Japanese Patent No. 3529954 discloses a method for determining facial features and categorizing individual features according to face length, the arrangement of formal elements of the eyes, eyebrows, mouth and nose, and the contour shape of those formal elements, and a facial feature categorizing map composed of coordinates generated based on that categorizing method. However, this method for categorizing facial features categorizes formal elements of the entire face based on their arrangement or contour shape, and was unable to be applied to categorizing the lips only.

Japanese Patent No. 3423311 proposes an eye makeup method composed of determining a personalized color based on the glossy color of the iris of the eyes to be made up, a contour color or an impression color, selecting a makeup product that matches the determined personalized color, such as respectively selecting a contour color for the eye liner, an impression color for the mascara, and a glossy color for the eye shadow and lipstick, and applying to each zone of the face. In this makeup method, it is proposed that the makeup product in the form of lipstick applied to the lips be matched to the glossy color of the iris of the eyes. However, this eye makeup method was developed for the purpose of being applied to Westerners having a diverse range of iris colors, and was unable to be applied as a makeup method for Japanese basically composed of black.

In addition, Japanese Patent No. 2986214 proposes a method and apparatus for determining a foundation color for reproducing natural human skin color by generating a database of combinations of skin colors of the inside of the arm, outside of the arm or intermediate region of the two and foundation colors relating to those skin colors, measuring the skin color of a specific person, comparing the measured skin color with skin colors stored in the database, selecting a skin color that approximates the measured skin color, and determining a corresponding skin color based on the selected skin color. However, although this method is suitable for selecting a foundation color that reproduces the inherent color of human skin, it was unable to be applied to a lip makeup method that must take into consideration shape, mouth width, ratio of the upper and lower lips and so on as elements used when applying makeup.

Japanese Patent Application Laid-open No. H8-206099 proposes a method for aesthetically categorizing lips by defining the width of the lips relative to the width of the face as a shape index, and defining the area of the lips determined as the product of the absolute length and width of the lips as a size index. However, since this categorizing method is unable to determine formal differences between lips, it was not advantageous for proposing a makeup method for correcting lip form. Japanese Patent Application Laid-open No. H8-202754 proposes a lip color advice system for finding and displaying a lip color that matches customer skin color data, group data and makeup image data by generating a database of facial skin color data, group data in which color preferences of people are grouped based on tolerance with respect to color, data on the desired makeup image of the user, and lip colors suitable for makeup images corresponding to this data. This lip color advice system merely proposes the selection of a suitable lip color, and does not propose a method for attractively making up the lips while correcting lip form.

DISCLOSURE OF THE INVENTION

The present invention proposes a method for categorizing lips based on formal features thereof, and a lip categorizing map composed of coordinates generated based on this lip categorizing method. This lip categorizing method and map can be used as a method for applying lip makeup, for providing aesthetic counseling to customers or for instructing beauty consultants and beauticians.

In addition, the present invention proposes a makeup technique for determining the formal features of lips and adjusting the determined formal features, a makeup method for making up the lips by applying makeup based on this technique, and a tool for simply and reliably realizing this makeup technique that is used when applying this technique.

Moreover, the present invention proposes lip form correction information for two-dimensionally or three-dimensionally analyzing lip form using images of the lips, judging the formal balance of the lips based on the two-dimensional analysis information, and judging the three-dimensional appearance of the lips based on the three-dimensional analysis information to obtain the optimum balance for the form of the lips.

In order to achieve the above objects, the categorizing method employed by this invention categorizes the lips using the size and shape of the lips as viewed from the front of the face as a first categorization index and using the three-dimensional form of the lips as a second categorization index, in order to enable determination of a formal image of the lips.

In addition, the categorizing map is composed of a first coordinate axis showing the degree of the first categorization index and a second coordinate axis showing the degree of the second categorization index, and is able to determine a formal image of the lips by composing a coordinate system in which the first and second coordinate axes are orthogonal.

The first categorization index is composed of the lateral width of the lips, the form of the crests and trough of the lips, and the form of the bottom of the lower lip, while the second categorization index is composed of whether the contour of the lips is linear or curved, and the three-dimensional form of the lips.

Moreover, the makeup method employed by this invention is composed of applying makeup to the lips by drawing contour lines of the lips by applying a technique for adjusting the form of the lips when applying a makeup method to the lips and applying the makeup based on these contour lines, and a technique for making a plurality of adjustments is composed of the five steps indicated below.

Step 1: The crests of the lips are positioned at vertical lines extending downward from the center of the nostrils.

Step 2: The shape of the bottom of the lower lip is aligned with the shape of the tip of the jaw.

Step 3: The shape of the lower lip is made to be nearly parallel with the jaw line.

Step 4: The line connecting the corners of the mouth is tightened.

Step 5: The angle from the trough to the crests of the upper lip is made to be within the range of 10 to 15 degrees.

The ratio of the upper and lower lips is made to be within the range of 1:1.3 to 1:1.5, and the adjustment range between the inherent lip contour lines and the drawn contour lines is within 2 mm.

In addition, a makeup tool able to be used in this makeup method has a scale extending in two directions in a V-shape along the shape of the trough and crests of the upper lip, and enables the shapes of the trough and crests of the upper lip to be drawn by aligning the V-shaped trough with the trough of the upper lip and aligning the scale with the crests. A handle is connected to one end of the scale, and the angle of the V shape of the scale can preferably be adjusted to within the range of 10 to 15 degrees.

Moreover, the makeup tool has a scale extending in two directions in a V-shape along the contour line of the lower lip, and enables the contour line of the lower lip to be drawn along the scale by aligning a V-shaped trough with the center of the lower edge of the lower lip and positioning the scale by aligning with the jaw line. A handle is attached to the center of the V-shaped scale extending downward, and the angle of the scale is either adjustable or fixed.

Moreover, another makeup method employed by this invention generates makeup information for two-dimensionally correcting the lips of a subject based on preset reference by setting a plurality of points for determining the formal features of lips on an image depicting the lips, and judging the formal features of the lips of the subject based on analytical values of the two-dimensional features of the lips measured from the set points.

In addition to analysis of two-dimensional features of the lips, the three-dimensional appearance of the lips is determined by analyzing three-dimensional features of the lips according to image brightness values.

The points used to determine formal features of the lips are comprised of the position of the nose, the center of the nostrils, the positions of the crests and trough of the upper lip, the center of the lips, the positions of the corners of the mouth, the center of the lower lip, and the position of the jaw.

The reference for generating makeup information for two-dimensionally correcting the lips is composed of the five parameters indicated below.

Parameter 1: Reference for indicating the positions of the corners of the mouth.

Parameter 2: Reference for indicating the position of the upper lip.

Parameter 3: Reference for indicating the position of the lower lip.

Parameter 4: Reference for indicating the positions of the crests of the upper lip.

Parameter 5: Reference for indicating the position of the trough of the upper lip.

The reference for indicating the positions of the corners of the mouth is defined as the positions determined based on the center of the lips, the reference for indicating the position of the upper lip is defined as the position one-third the distance from the oral split to beneath the nose, the reference for indicating the position of the lower lip is defined as the position one-third the distance from the oral slit to the position of the jaw, the reference for indicating the positions of the crests of the upper lip is defined as the positions below the center of the nostrils, and the reference for indicating the position of the trough of the upper lip is defined as the position 10 degrees downward from the crests towards the trough.

The present invention also simultaneously displays the inherent outline of the lips and an outline of two-dimensionally corrected makeup information of a subject's lips on an image of the subject's lips.

According to the lip categorizing method and categorizing map of the present invention, since lips are able to be displayed on a map by categorizing the lips based on formal features thereof, changes in the formal features of lips can be determined at different time periods by comparing categorization results generated at certain time intervals. In addition, the present invention can be used when applying makeup by using categorization results to analyze the features of the lips of a specific person and determining an image of the lips provided by a categorized group, or the present invention can be useful in training beauty consultants and beauticians.

According to the lip makeup method of the present invention, a makeup method can be proposed that enables makeup evaluated as being attractive to be applied easily and reliably by adjusting the formal features of lips. In addition, the use of the makeup tool of the present invention makes it possible realize the makeup method easily and reliably.

According to another lip makeup method of the present invention, information for analyzing, judging and correcting the formal features of lips by applying makeup can be proposed on a computer screen, and makeup information of the lips that enables them to appear attractive in the optimum balance can be proposed while meeting with a customer.

BEST MODE FOR CARRYING OUT THE INVENTION

Figure 1:
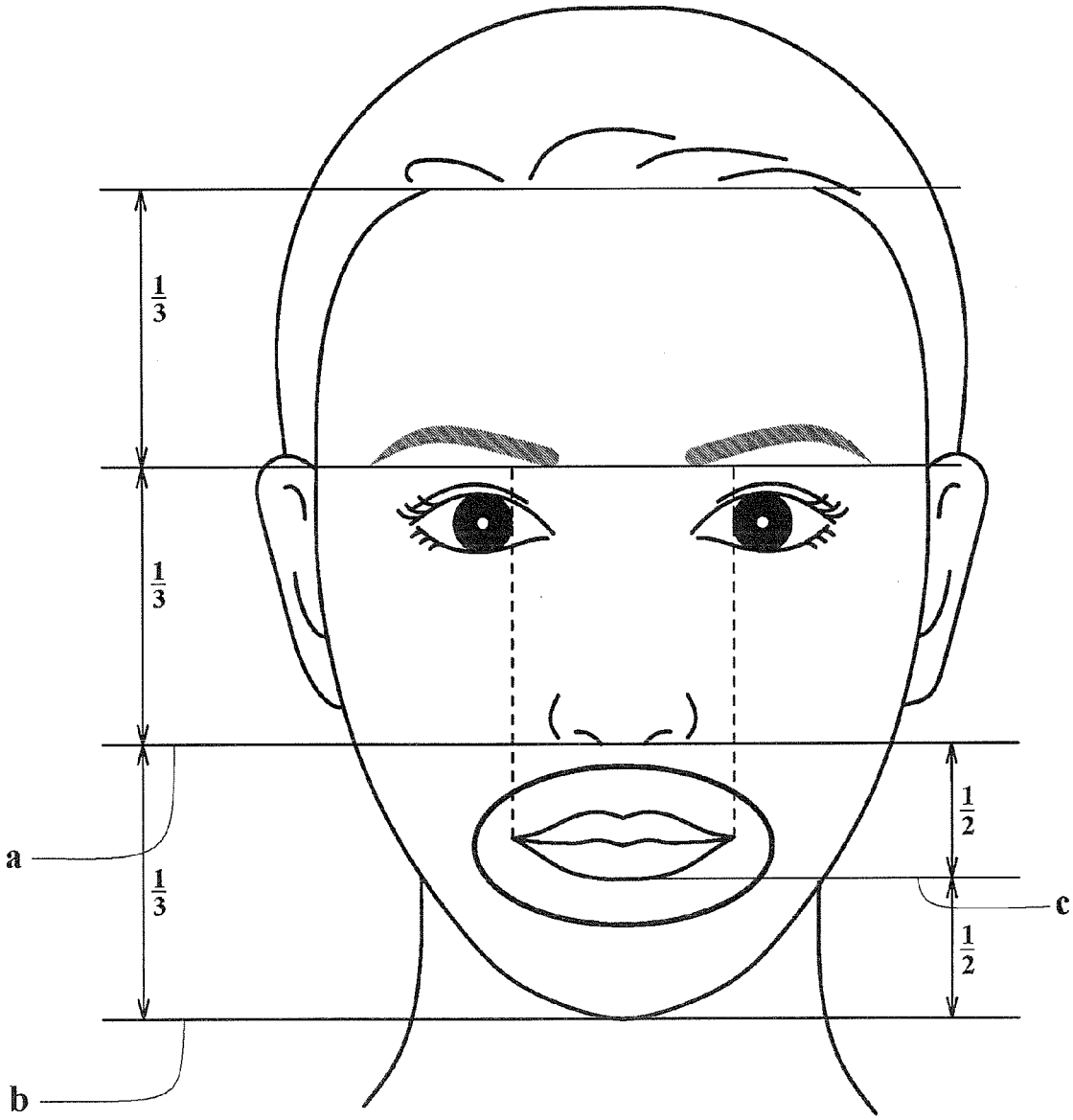
FIG. 1 is a drawing showing standard proportions of the face.

The following provides a detailed explanation of a preferred mode for carrying out the present invention. FIG. 1 is a drawing showing conventionally known standard facial proportions that are widely used for providing makeup advice to customers and for instructional purposes by beauty researchers of cosmetics manufacturers, beauty consultants providing beauty information to customers at stores and so on. These standard proportions are the result of using computer graphics technology to morph a plurality of faces evaluated as being attractive by compiling questionnaires given to a plurality of evaluators. In these standard proportions, the proportions of the lips are numerically characterized using the position of the mouth, the width of the mouth and standard features of the lips are indices. With reference to FIG. 1, the position of the lips is defined as the position (c) where the bottom line of the lower lip is located at one-half the length from the wings of the nose (a) to the tip of the jaw (b), and the width of the mouth is defined as the position where both ends of the lips are located where vertical lines extend vertically downward from the insides of the irises of both eyes. In addition, in the case of standard lips, the crests of the lip are defined as being located at three-fourths the distance from a corner of the mouth to the center of the lips, and the ratio of the thickness of the upper lip to the lower lip is defined as being 1:1.5.

In the case of a beauty consultant providing lip makeup advice to a customer at a store, a makeup method is proposed that adjusts the lips so as to approach the standard lips in accordance with indices defined in this manner. Furthermore, in cases in which lips require adjustment, changes are made within a range of about 2 mm to avoid having the results of adjustment appearing unnatural. However, these standard proportions were generated more than twenty years ago, and not only facial proportions, but also the forms of the lips and jaw have changed over time accompanying considerable changes in dietary habits. In particular, the lips of twenty-year-old modern women have a form in which the width of the mouth is smaller, the ratio between the upper and lower lips is closer, and has a thicker, fuller image as compared with the lips of women twenty years ago, thus making it necessary to alter the above-mentioned standard proportions. In addition, conventional standard lip proportions used only four elements as indices, namely the position of the mouth, the width of the mouth, the position of the crests of the upper lip and the ratio of the thicknesses of the upper and lower lips, and this number of elements is considered to be too few and general for determining lip proportions.

Therefore, in addition to first examining a method for categorizing lips based on the formal features thereof to establish a lip categorizing method, the inventors of the present invention represented formal features based on that categorizing method with coordinates to develop a categorizing map capable of positioning classified lip forms. This lip categorizing method and categorizing map facilitated the determination of the formal features and image of women's lips. In addition, since the lips of modern women, and particularly twenty-year-old women, have a thicker and fuller image as previously described, the ratio of the thicknesses of the upper and lower lips was presumed to most likely change from the standard ratio of 1:1.5 as previously described, and a study was made of that change. Moreover, a method for attractively making up lips was also examined and technical rules were developed for drawing lips attractively. The use of these technical rules made it possible to propose the optimum makeup method for the lips of a specific person, while also enabling makeup to be applied to lips that would be recognized as being attractive by another person. Moreover, a tool is proposed that enables these technical rules to be applied easily by assisting in the application of these rules at the time of the application thereof.

Categorizing Method and Categorizing Map

First, an explanation is provided of the lip categorizing method and categorizing map as claimed in the present invention. When categorizing the form of lips, the inventors of the present invention focused on five points relating to the three-dimensional form of the lips consisting of 1) the lateral width of the lips, 2) the form of the crests and trough of the lips, 3) the form of the bottom of the lower lip, 4) whether the contour of the lips has a linear form or curved form, and 5) the three-dimensional form of the lips, and proposed that the form of the lips be categorized using these five points as indices. The validity of categorization using these points was confirmed with a questionnaire survey. Those points consisting of 1) the lateral width of the lips, 2) the form of the crests and trough of the lips, and 3) the form of the bottom of the lower lip represent the size and shape of the lips when viewed from the front. Therefore, the formal features of 1) to 3) were compiled as one group and used as first categorization indices. In addition, since those points consisting of 4) whether the contour of the lips has a linear form or curved form, and 5) the three-dimensional form of the lips represent the three-dimensional features of the lips, the formal features of 4) and 5) were compiled as another group and used as second categorization indices. The categorizing map plots the first indices on a first categorization axis and the second indices on a second categorization axis, and composes a coordinate system in which the first and second axes are orthogonal, with lips having the standard form being located in the center of the coordinate system.

Figure 3:
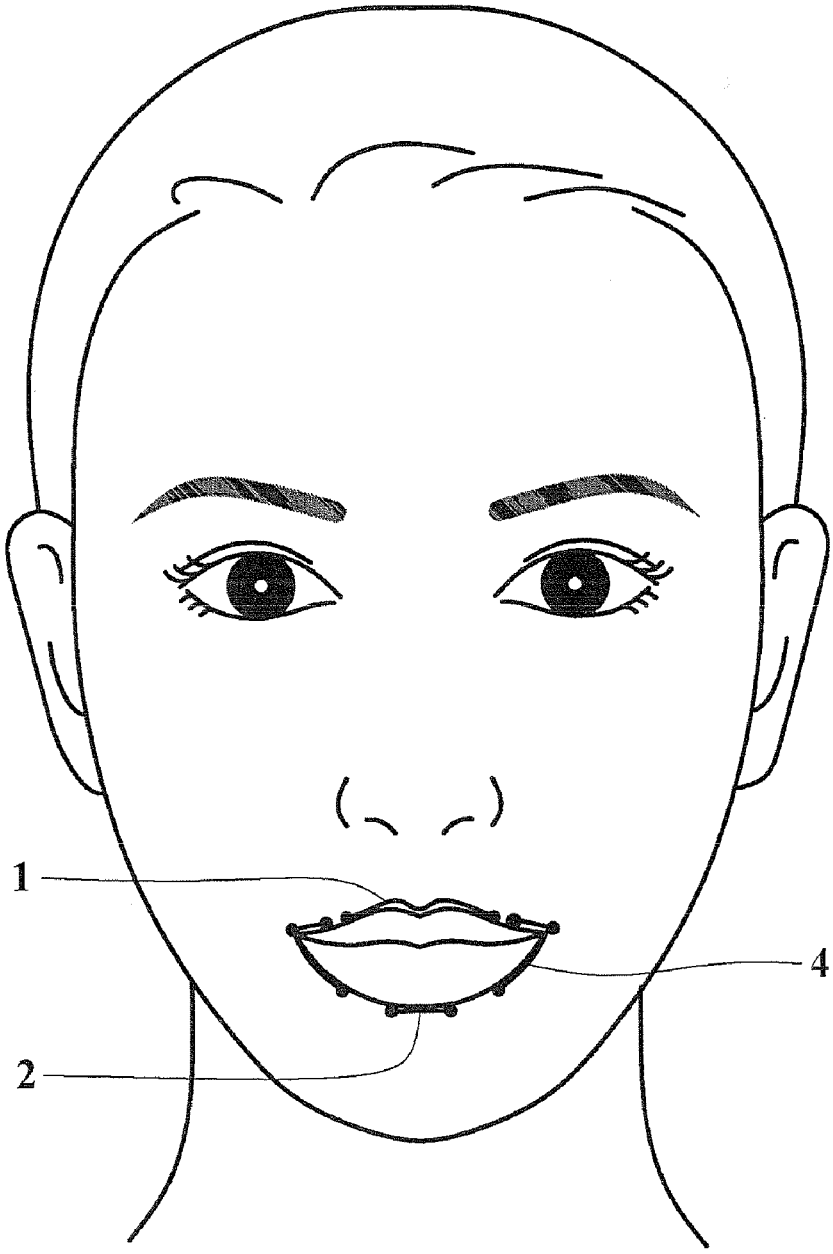
FIG. 3 is a frontal view showing points serving as classification reference of the lips.
Figure 4:
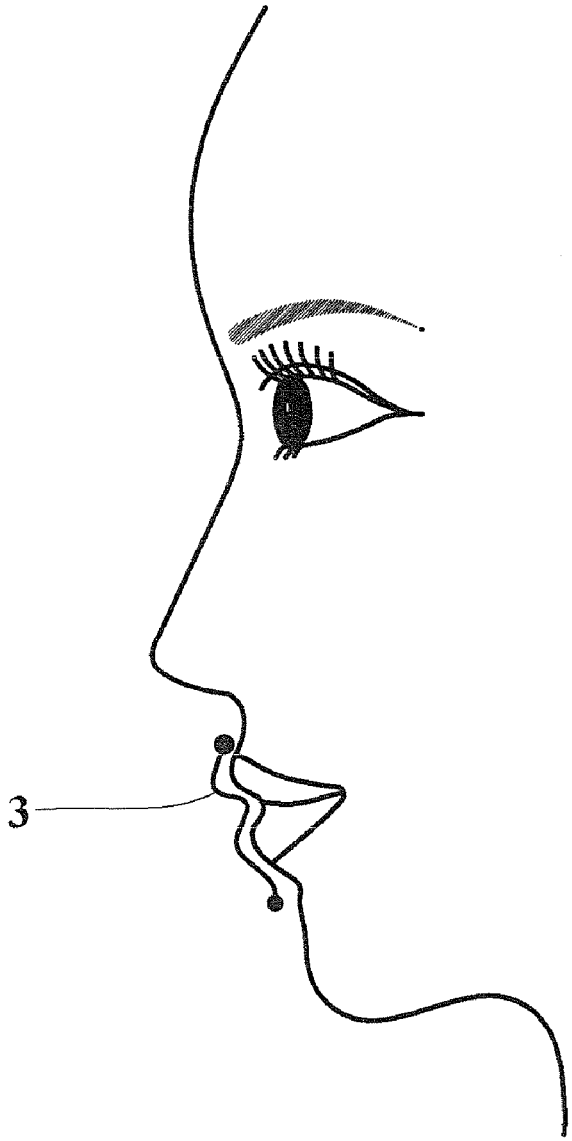
FIG. 4 is side view of the same.

FIGS. 3 and 4 show the locations of points serving as the above-mentioned indices 2) to 5). In FIGS. 3 and 4, reference symbol 1 indicates the crests and trough of the upper lip, reference symbol 2 indicates the bottom of the lower lip, and reference symbol 3 indicates the three-dimensional form of the lips. Whether or not the contour of the lips is linear or curved is determined by whether the form of the bottom and both sides of the lower lip (portion indicated by reference symbol 4) mainly has a linear shape or a curved shape. The questionnaire involved the preparation of photographs depicting the lips and lower half of the faces of fifty female students currently 20 years old, and having 23 beauty researchers assess those parameters and feature points thought to be characteristic of the form of the lips and jaw. In addition, similar parameters and feature points were assessed by a questionnaire for photographs of twenty female office workers taken 20 years ago. As a result of analyzing the replies to these questionnaires, the previously selected points 1) to 5) were confirmed to be effective as indices for representing the features of the lips.

Figure 5:
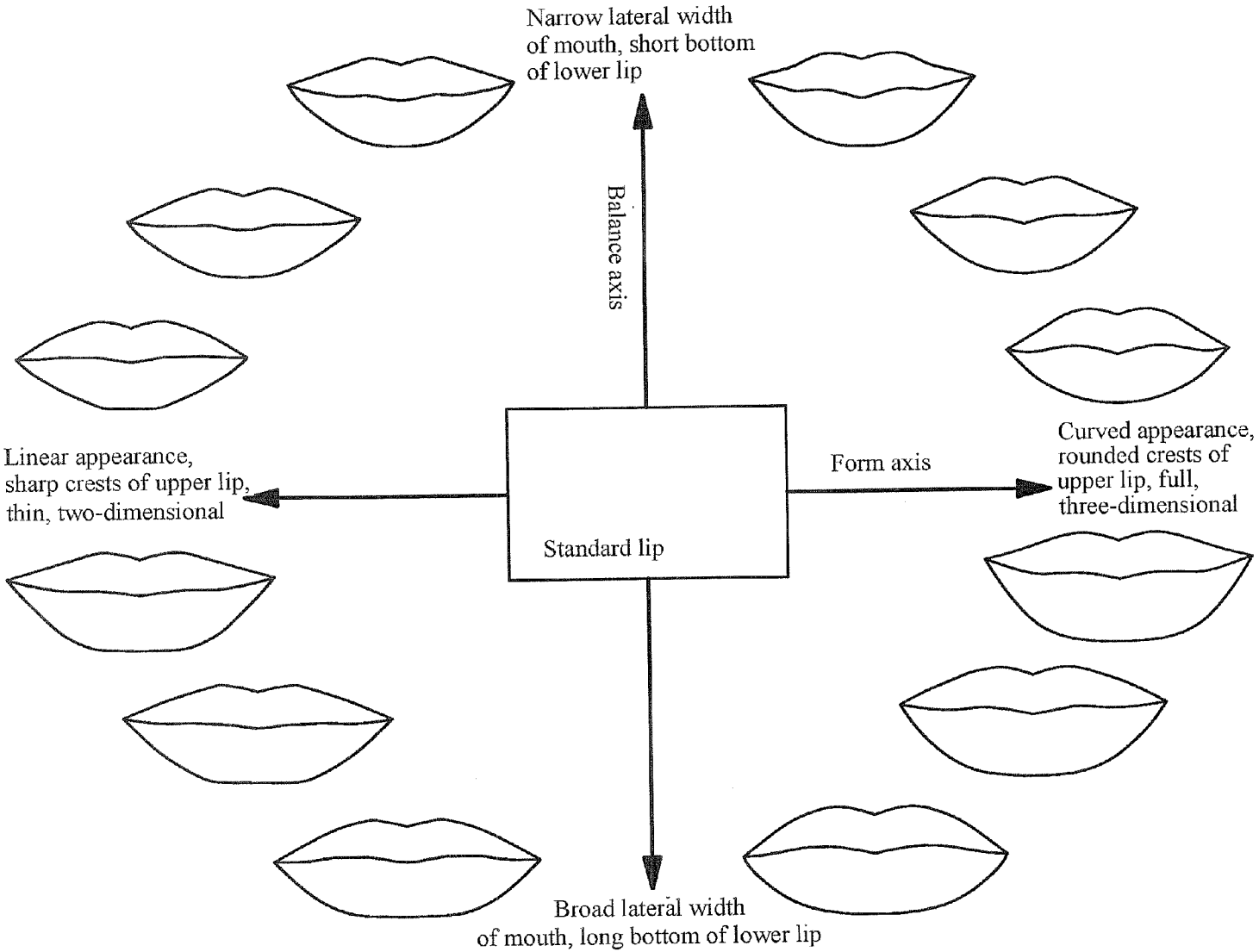
FIG. 5 is a drawing showing a categorizing map.

The first categorization axis that composes the coordinates of the categorizing map indicates the degree of 1) the lateral width of the lips, 2) the form of the crests and trough of the upper lip, and 3) the form of the bottom of the lower lip, and is referred to as the balance axis. In addition, the second categorization axis indicates the degree of 4) whether the contour form of the lips is linear or curved, and 5) the three-dimensional form of the lips, and is referred to as the form axis. FIG. 5 shows a categorizing map composed of these two axes, and is composed of coordinate system using the first categorization axis (balance axis) as the vertical axis and the second categorization axis (form axis) as the horizontal axis, with lips having the standard form located in the center of the coordinate system. The standard lips may have a form of lips having the standard proportions shown in FIGS. 1 and 2, or may have a form of lips recognized as being attractive by a large number of evaluators as determined with a questionnaire.

With reference to FIG. 5, forms having a narrow lateral width of the mouth and short bottom of the lower lip, and forms having a small angle between the crests and trough of the upper lip are located at the upper end of the balance axis (vertical axis) of the categorizing map, while forms having abroad lateral width of the mouth and long bottom of the lower lip, and forms having a large angle between the crests and trough of the upper lip are located at the lower end. In addition, forms in which the form of the lips appears to be curved overall, forms in which the crests of the upper lip are rounded and forms in which the lips appear to be full and three-dimensional are located at the right end of the form axis (horizontal axis), while forms in which the form of the lips appears to be linear overall, forms in which the crests of the upper lip are sharp, and forms in which the lips appear to be thin and two-dimensional are located at the left end. Each of these forms represents a facial impression and image. Moving towards the upper end of the balance axis results in a cute, childish image, while conversely moving towards the lower end results in a more mature, refined image. In addition, moving towards the right end of the form axis results in a sense of curvature associated with a gentle, feminine image, while moving towards the left end results in a more linear sense associated with a sharper, refreshing and active image.

Figure 6:
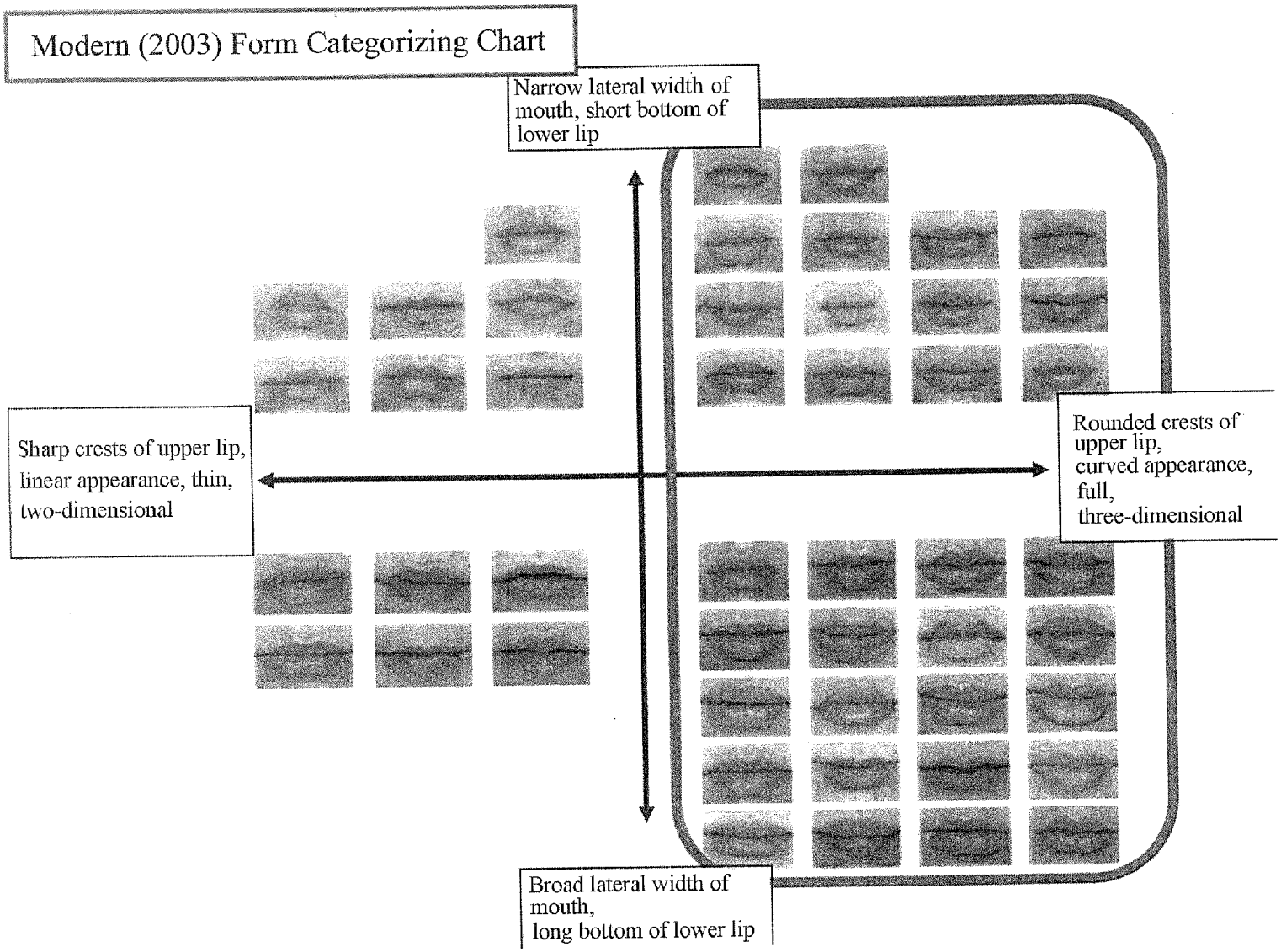
FIG. 6 is a categorizing chart of the lips of modern women.
Figure 7:
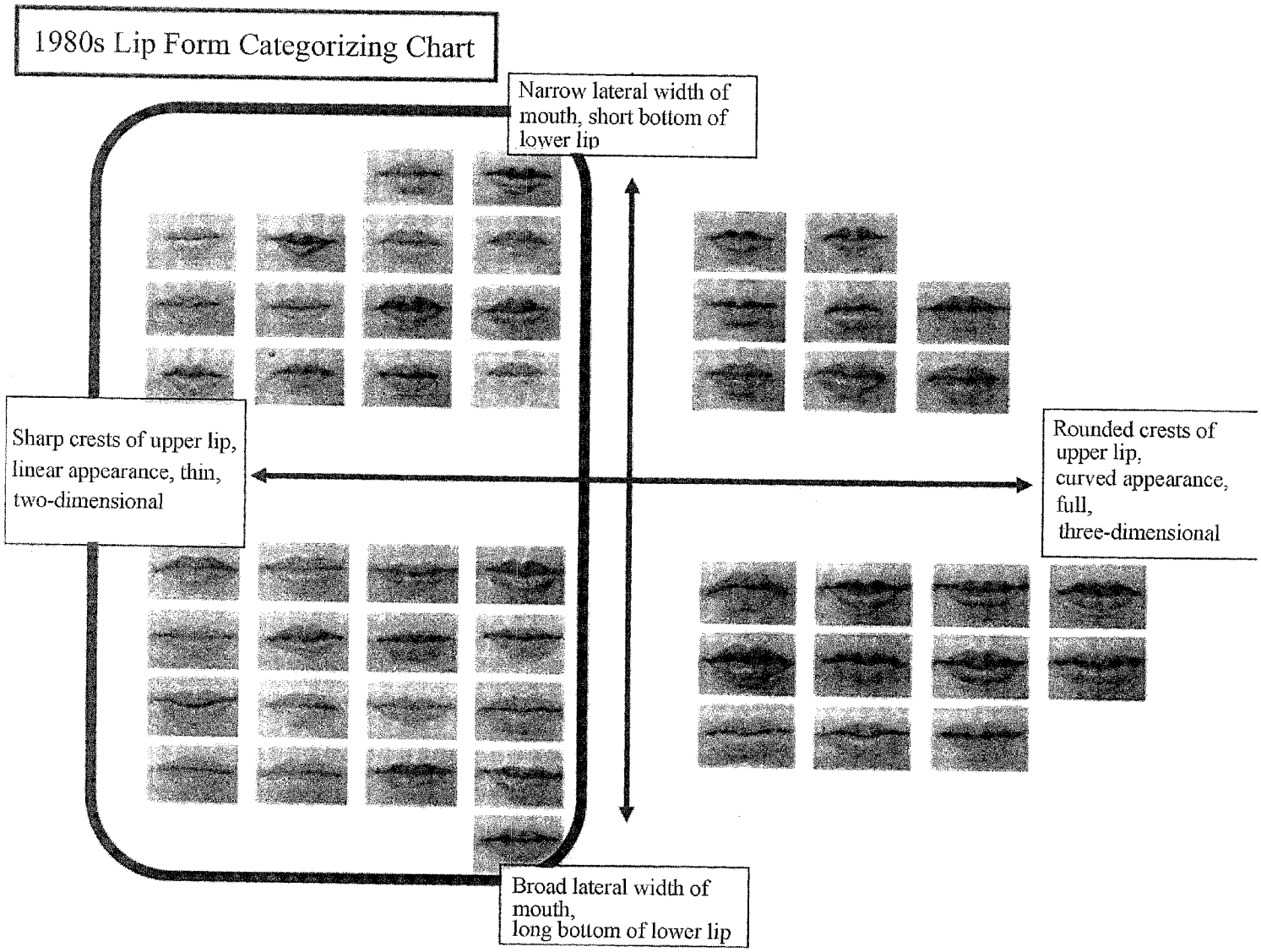
FIG. 7 is a categorizing chart of the lips of women of twenty years ago.

FIG. 6 is a categorizing chart displaying the forms of the lips of the fifty previously mentioned modern 20-year-old women on the categorizing map of FIG. 5, while FIG. 7 is a categorizing chart displaying the same for fifty 20-year-old women from twenty years ago. In each categorizing chart, the position of each set of lips is arranged based on the formal features thereof, and the formal features and image of each set of lips can be determined according to that position. In the categorizing chart of FIG. 6, the number of lips located in the coordinate plane on the right side of the vertical axis (balance axis) can be seen to be greater than the number located on the left side and in FIG. 7, the number of lips in the coordinate plane on the left side can be conversely seen to be greater than on the right side. On the basis of this, it was possible to confirm the presumption that, in addition to facial proportions, the form and size of the lips and jaw have changed over time accompanying changes in dietary habits as previously mentioned. Thus, in addition to the map of this invention being able to be used to determine a specific image of the lips, provide advice when applying makeup or serve as an instructional tool for beauticians and so on, it is also able to be used to determine and confirm changes in the forms of lips accompanying changes in the times.

Figure 8:
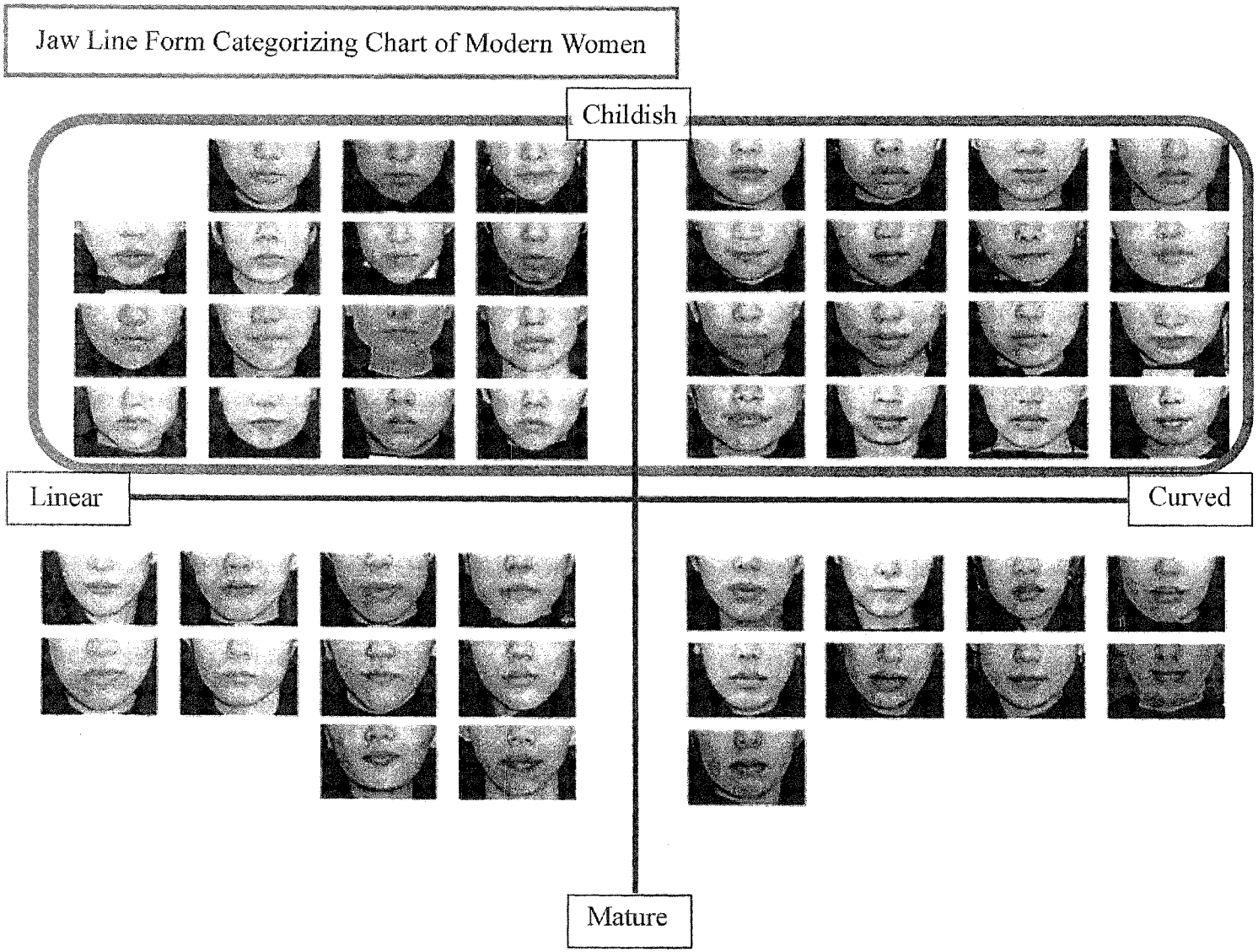
FIG. 8 is a categorizing chart of the shape of the jaw of modern women.
Figure 9:
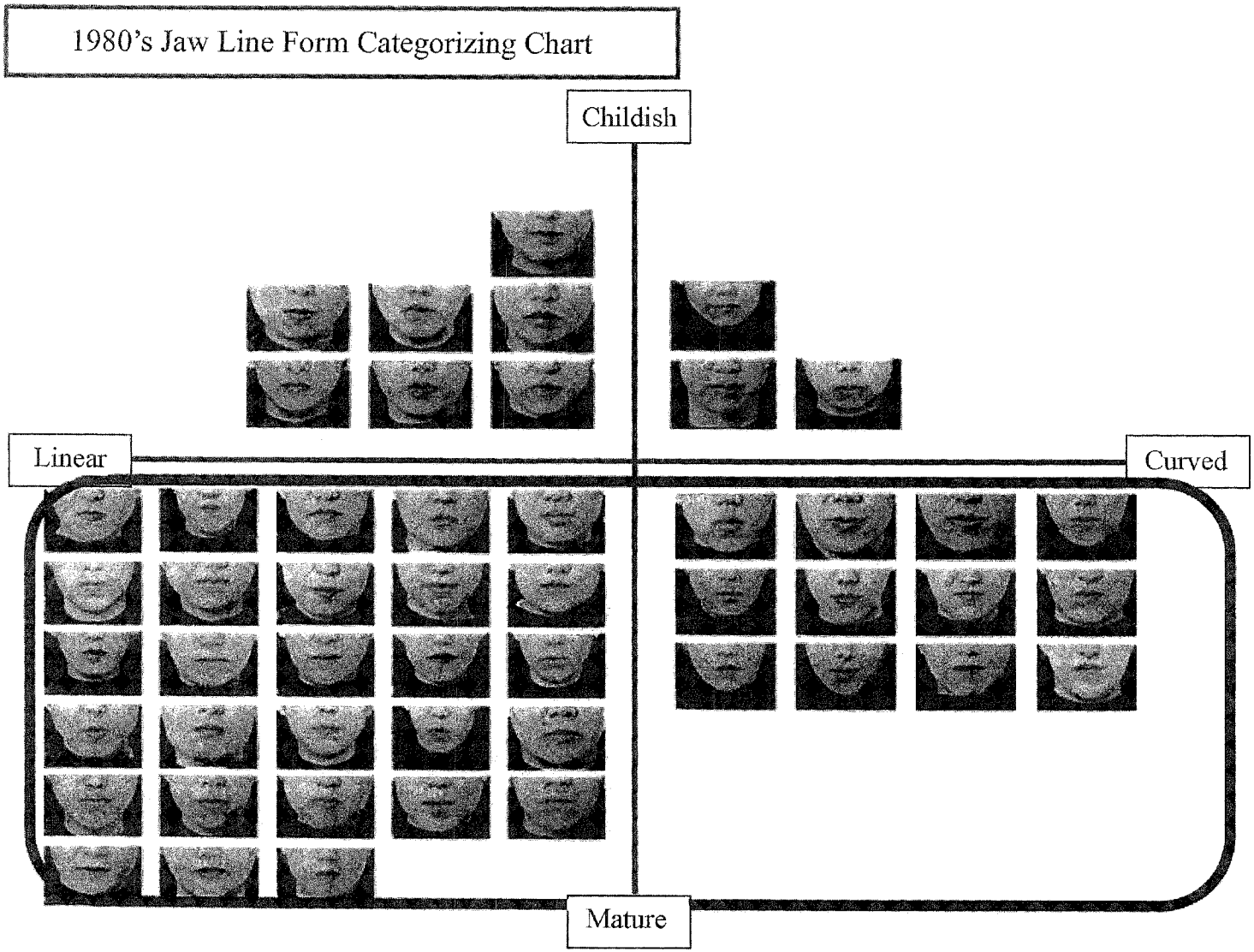
FIG. 9 is a categorizing chart of the shape of the jaw of women twenty years ago.

As was previously described, due to changes in dietary habits in the form of greater consumption of soft foods as compared with 20 years ago, since the form of the face, and particularly the development of the jaw at least with respect to the form of the jaw, is presumed to be becoming less narrower and sharper and more rounded as compared with 20 years ago resulting in a more childish face, the forms of the lower half of the face of fifty modern women and fifty women from 20 years ago were categorized using the balance axis, which indicates the degree of a childish face or mature face, and the form axis, which indicates the degree of a three-dimensional linear form or curved form, to confirm this, thereby making it possible to obtain the categorizing charts shown in FIGS. 8 and 9. In contrast to many of the modern women shown in FIG. 8 being located in the upper half of the map, the majority of the women from 20 years ago shown in FIG. 9 are located in the lower half of the map, thereby confirming the above-mentioned presumption by being able to evaluate that, in contrast to modern women having a somewhat short lower half of the face, a childish face and a small jaw line, women of 20 years ago have longer lower half of the face, a mature face and a prominent jaw line.

Ratio of Upper and Lower Lips

Figure 2:
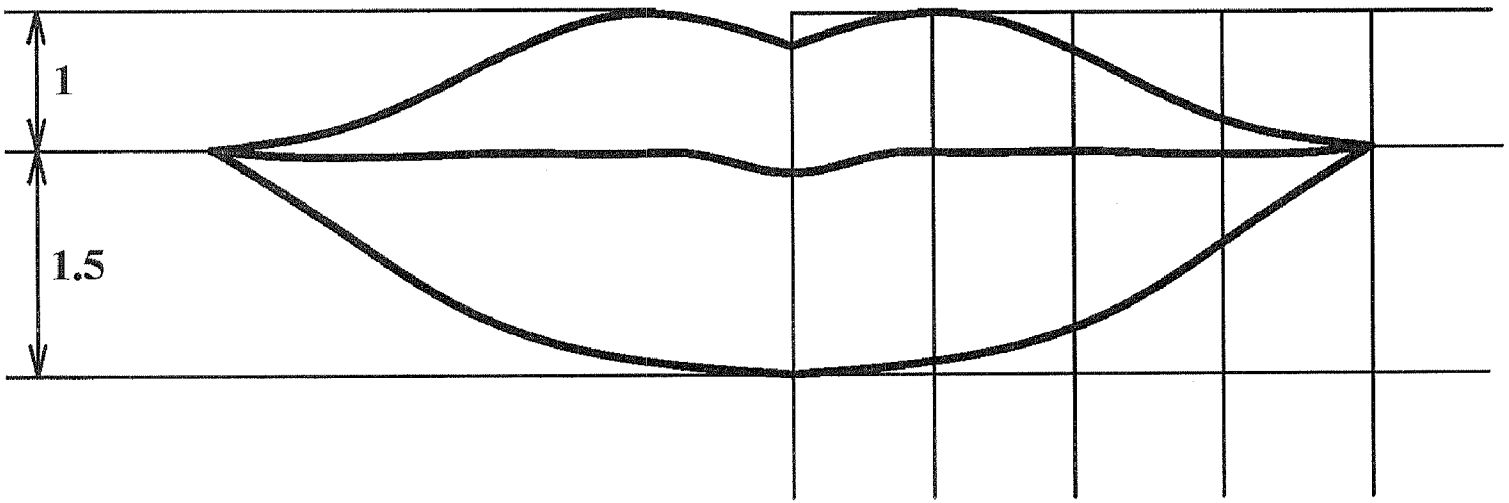
FIG. 2 is a drawing showing standard proportions of the lips.

As was previously described in relation to FIGS. 1 and 2, although the ratio of the upper and lower lips in the conventional standard proportions was 1:1.5, since the lips of modern women are such that there are many women located in the coordinate plane on the right side of the balance axis, the lips have a curved sense, the crests of the upper lip are rounded and the lips have a three-dimensionally full image as can be understood from the categorizing chart of FIG. 6, there is the possibility that the ratio of the upper and lower lips is also changing. Therefore, when the dimensions of the upper and lower lips of all 50 of the modern women were measured, calculation of the average value thereof yielded a ratio of 1:1.43. In addition, the average value of the ratio of the upper and lower lips for those women located in the coordinate plane on the right side, who can be considered to have the features of modern women, was 1:1.3. Moreover, questionnaire evaluators were asked as to which lips of the fifty women they thought were the most attractive and which lips of those women located in the coordinate plane on the right side they thought were the most attractive.

Moreover, a single lip form was respectively extracted for the lips of all fifty women and those of women located in the right coordinate plane by compiling two groups of lips using a morphing technique by computer graphics. A comparison of the lips determined according to the results of the questionnaire and the lips generated by morphing revealed both to be substantially the same. Therefore, the average value of three groups of lips, the lips compiled from all fifty women, the lips compiled from women located in the right coordinate plane, and the lips of the standard proportions was calculated, and this yielded a ratio of the upper and lower lips of 1:1.4. On the basis of this result, the ratio of the upper and lower lips of modern women was able to be determined to be from 1:1.3 to 1:1.43. Namely, this ratio has changed from conventional ratio of the upper and lower lips of 1:1.5. However, since there is an adequate basis for the conventional ratio and can be understood to be a ratio that is adequately applied to modern women as well, the ratio of the upper and lower lips can be said to be within the range of 1:1.3 to 1:1.5. Thus, in the case of applying makeup to the lips, if the lips are made up so as to be within this range, they can be considered to be able to be evaluated as having balance between the upper and lower lips.

Lip Makeup Method

Figure 10:
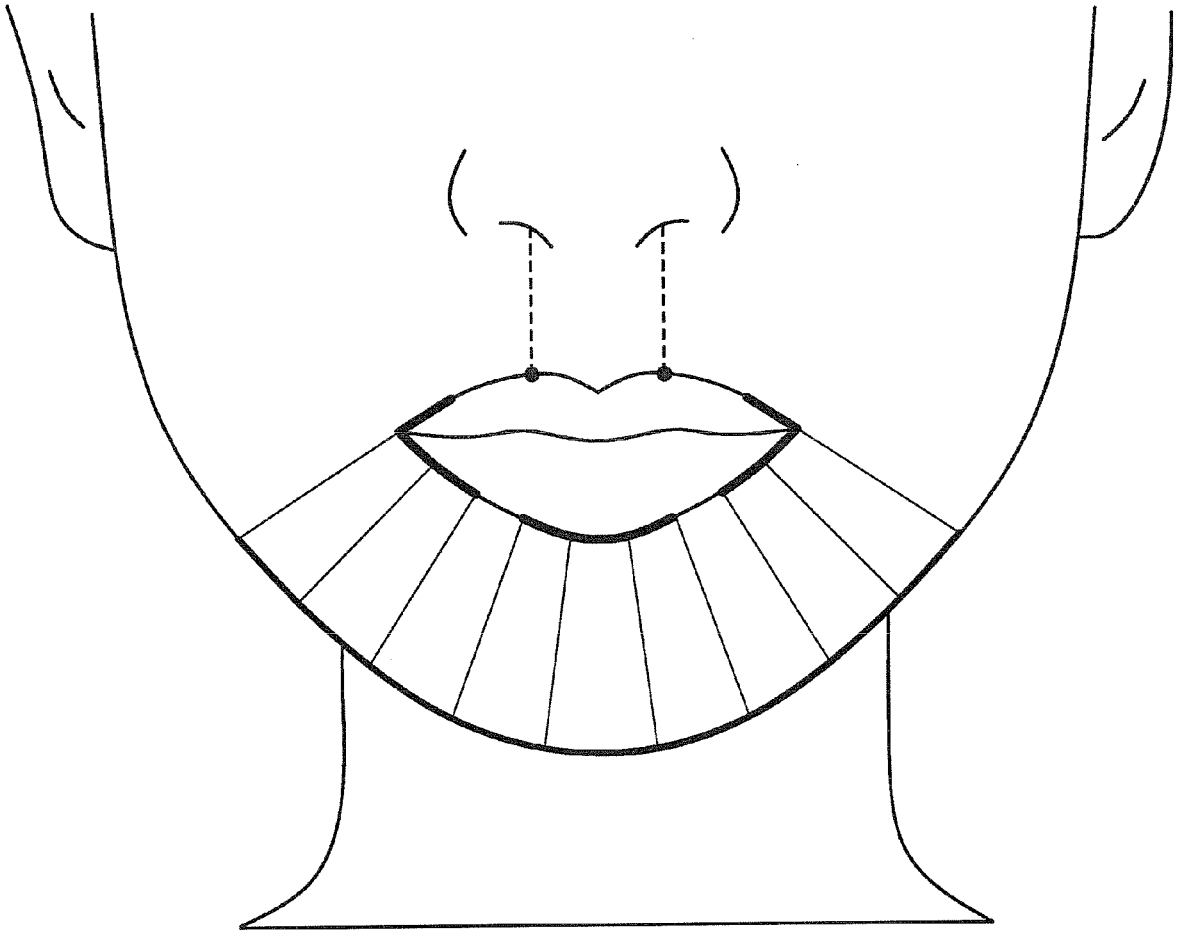
FIG. 10 is a drawing showing a lip makeup technique.
Figure 11:
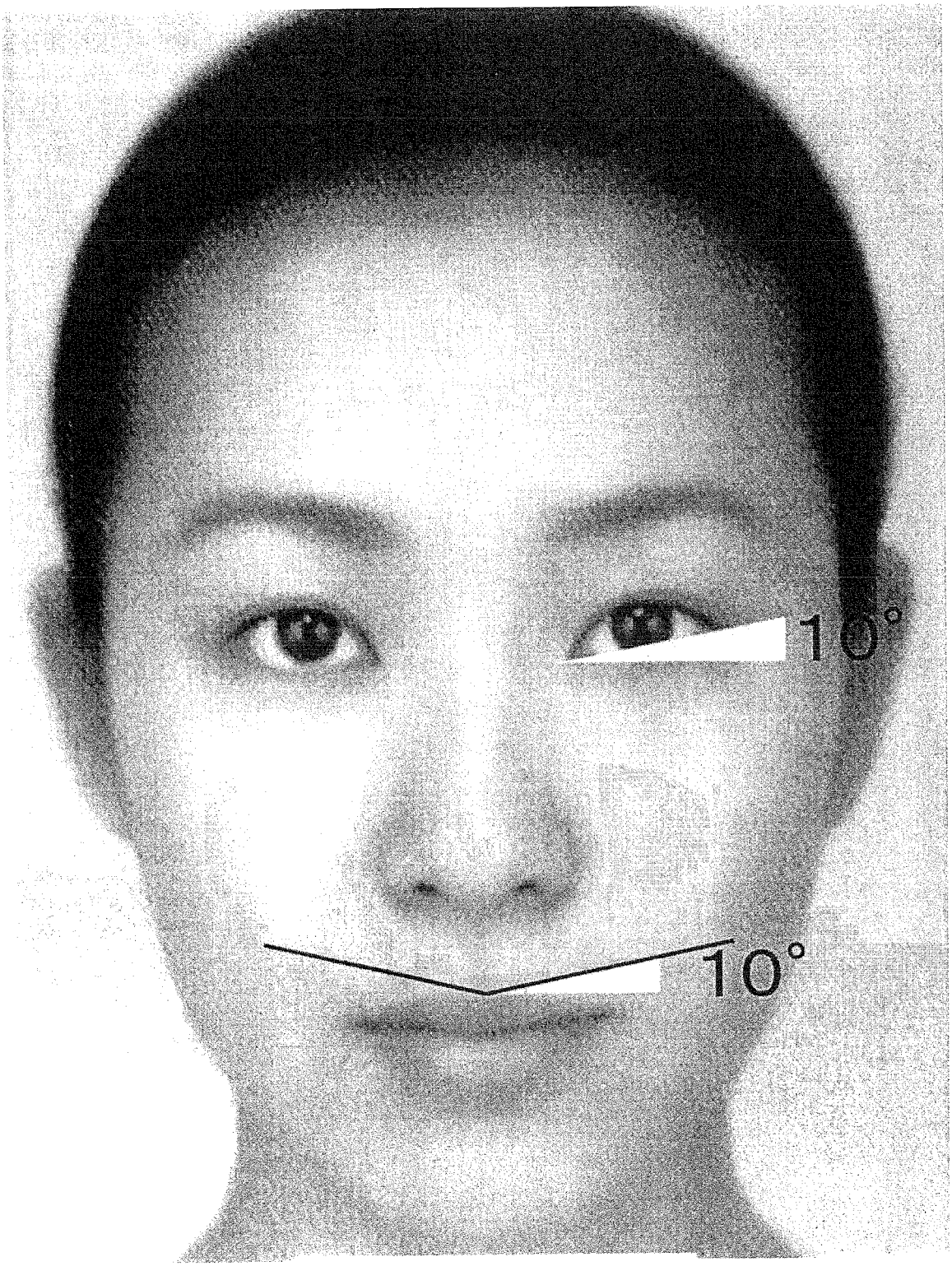
FIG. 11 is a drawing showing a 10 degree angle between the crests and trough of the upper lip.
Figure 12:
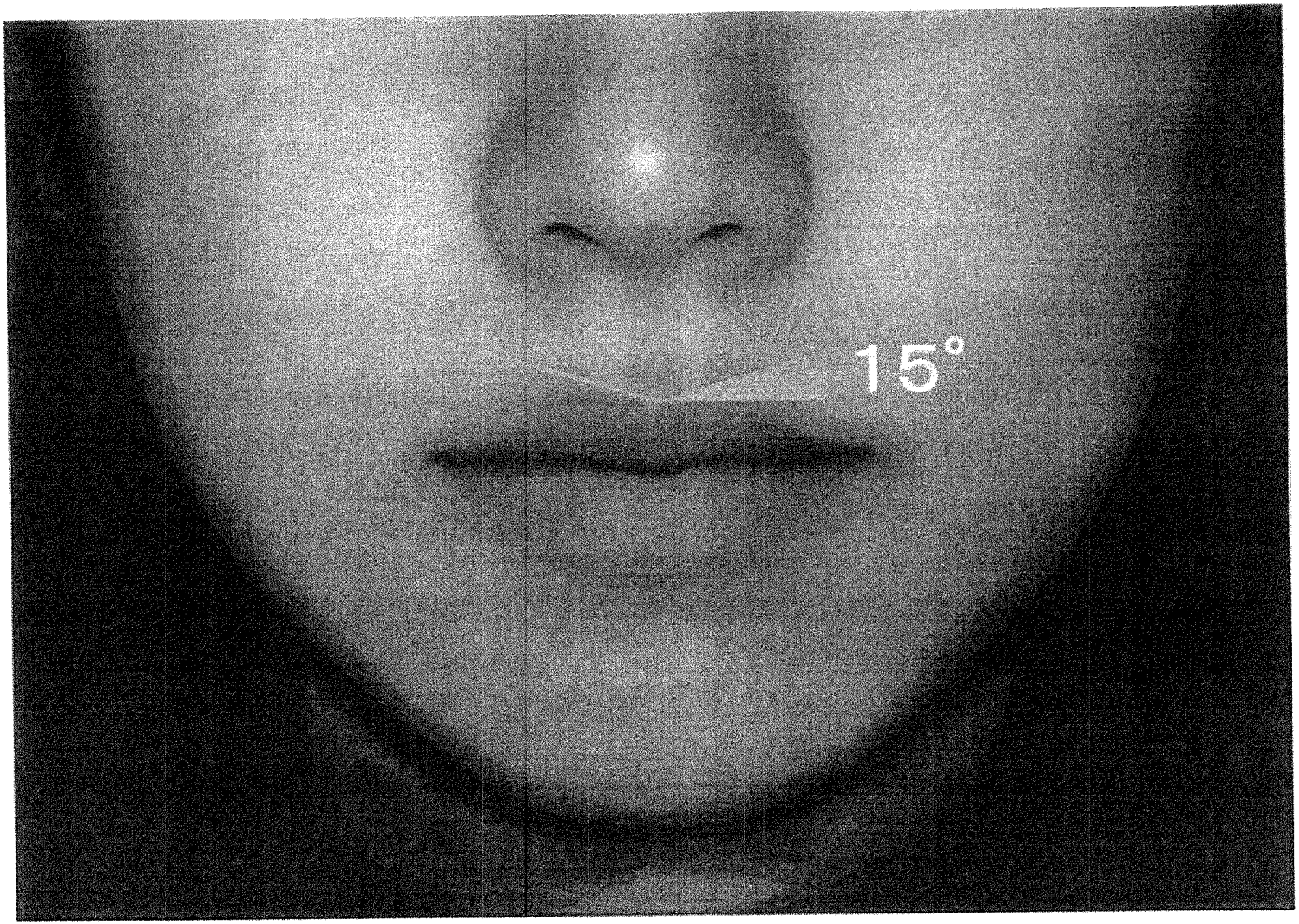
FIG. 12 is a drawing showing a 15 degree angle of the same.

The inventors of the present invention proposed a technical technique for drawing lips able to be evaluated as attractive while using the previously explained categorization and ratio of the upper and lower lips. Next, that makeup technique is explained in detail with reference to FIGS. 10 to 12. This technique is composed of the following five steps 1) to 5). In step 1), the crests of the upper lip are positioned at vertical lines extending downward from the center of the nostrils. In step 2), the bottom of the lower lip is made to be nearly the same shape as the shape of the tip of the jaw. In step 3), the shape of the lower lip is made to be of a shape that is parallel with the jaw line and in the proper balance with the space between the jaw and the lips. In step 4), the line connecting the corners of the mouth is tightened. In step 5), the angle from the trough to the crests of the upper lip is made to be within the range of 10 to 15 degrees. Furthermore, these steps do not indicate the order in which the steps are applied, and the order in which the steps are applied may be interchanged.

Figure 13:
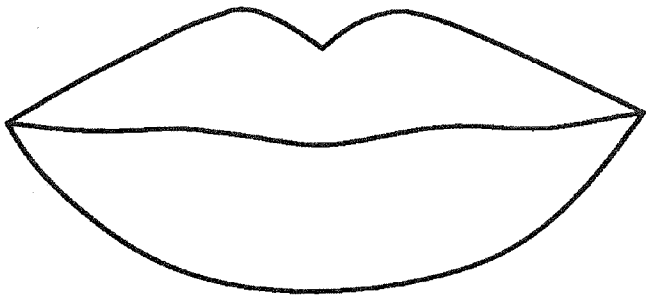
FIG. 13 is a drawing showing the shapes of lips in which the angle between the crests and trough is outside the range of 10 to 15 degrees.
Figure 13:
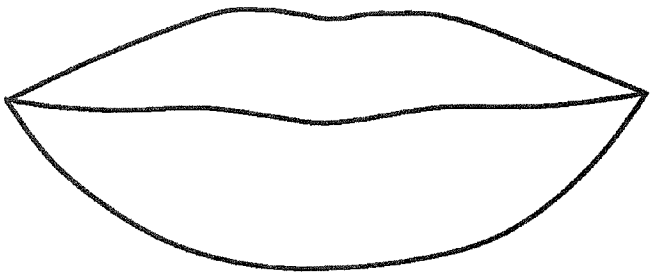

Steps 1) to 5) of this makeup technique were developed by drawing the lips of various forms and textures of ten monitors, taking photographs of those lips, asking 34 beauticians serving as evaluators to evaluate each set of lips and analyzing and compiling the formal features of those lips which were positively evaluated as being beautiful or attractive based on the results of the evaluations. The angle from the trough to the crests of the upper lip of step 5) has an angle of 10 degrees in the case of standard lips, and if this angle is smaller than 10 degrees, the lips become excessively flat as shown by the lips on the left side of FIG. 13. In addition, when lips morphed from the fifty modern 20-year-old women were measured, the angle was found to be 15 degrees, and if this angle exceeded 15 degrees, the crests of the upper lips appear excessively high and conspicuous as in the lips on the right side of FIG. 13, thereby making this undesirable.

Figure 14:
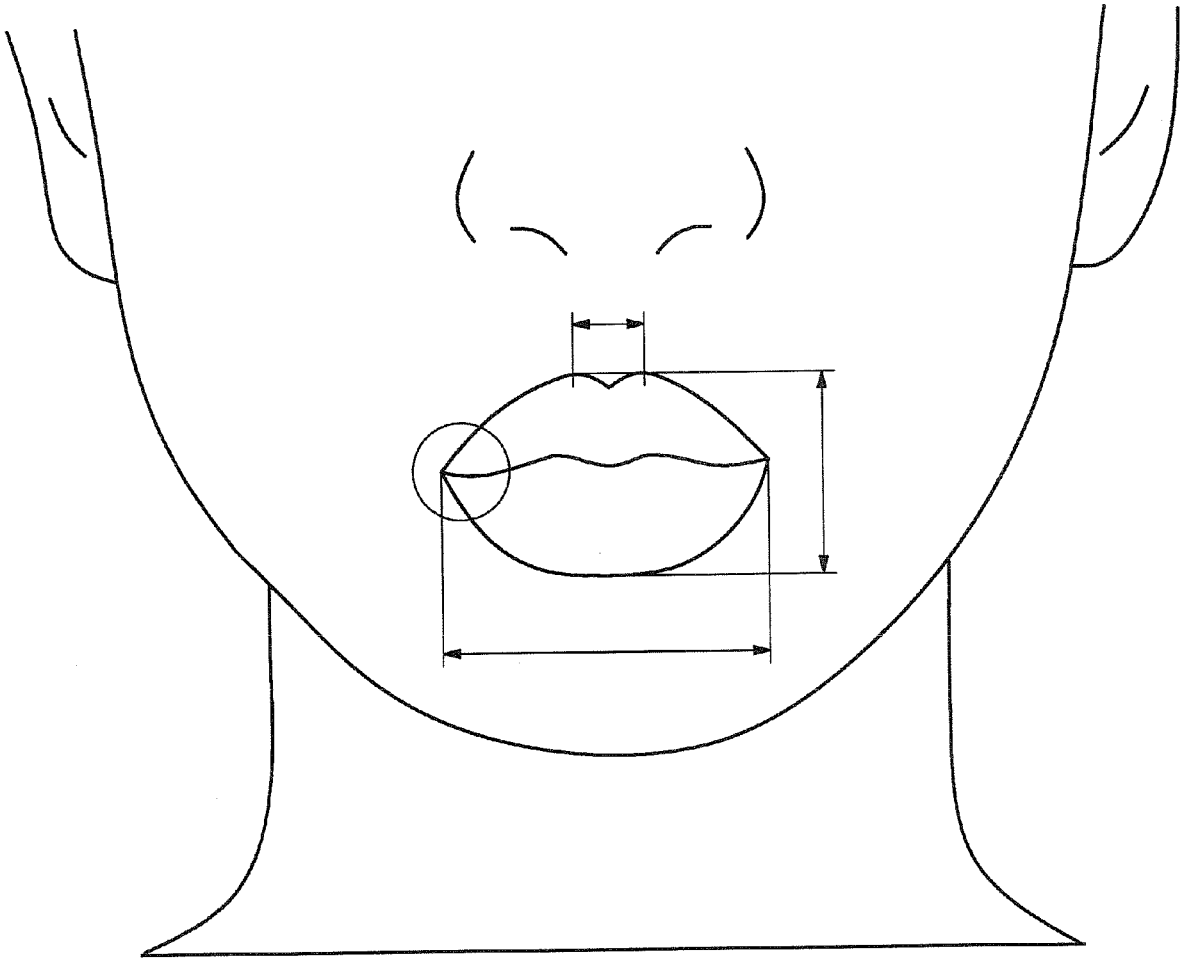
FIG. 14 is a drawing showing the contour lines of the lips of a model A.
Figure 15:
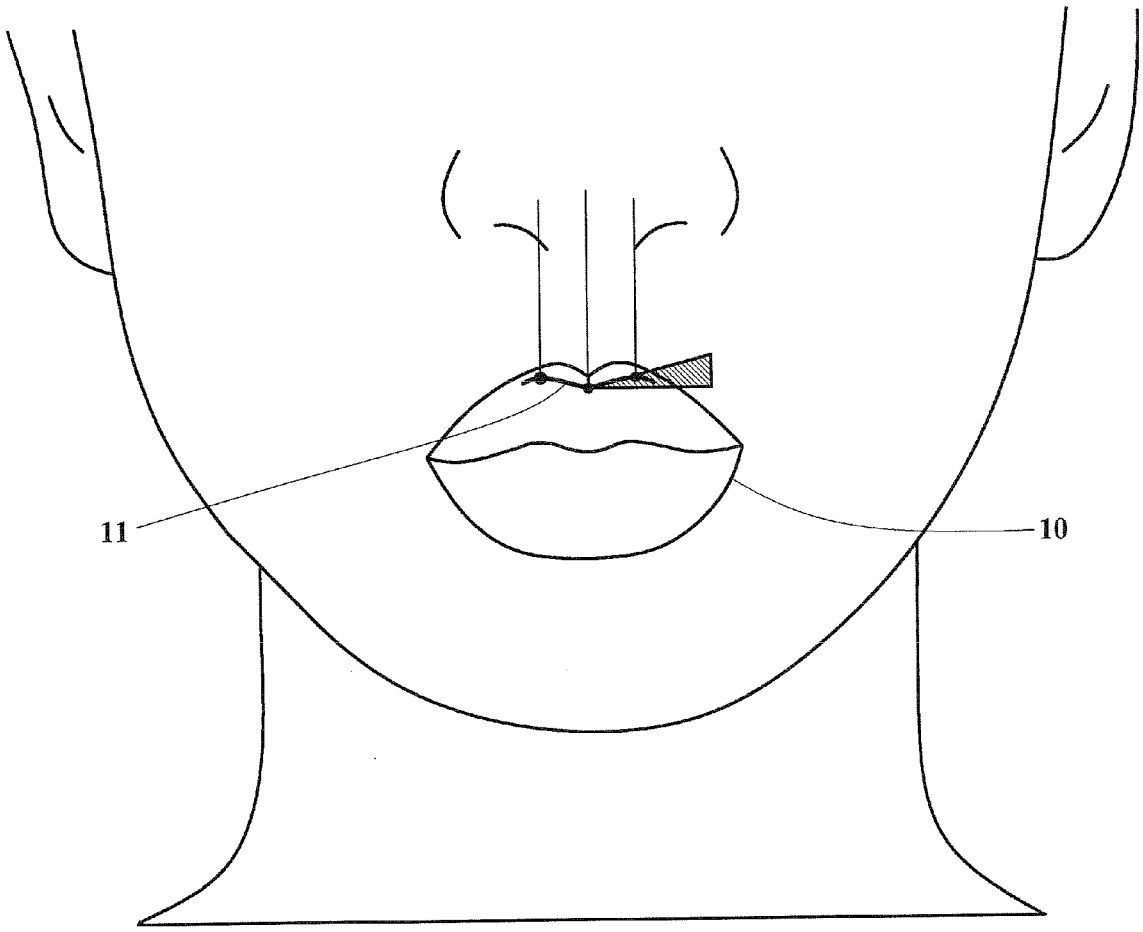
FIG. 15 is a drawing showing the adjusted contour lines of the crests and trough of a model A.

Next, the case of actually making up the lips of a model A using the makeup technique described above is explained with reference to FIGS. 14 to 18. FIG. 14 shows the lips of the model A, and the form is clearly defined by drawing a lip contour line (10). Features of the lips of the model A including being thick overall, the crests of the upper lip are close together, the width of the mouth is narrow, and the corners of the mouth are turned downward, thus indicating the need for adjustment. Furthermore, in the case of lips requiring adjustment, it is necessary to make changes within the range of about 2 mm to avoid the results of the adjustments appearing unnatural. First, with reference to FIG. 15, the crests of the upper lip are drawn at positions vertically below the centers of the nostrils. At this time, the troughs are positioned somewhat lower than the tangent with the upper lip to adjust the thickness of the lips, and the makeup line (11) of the trough and crests of the upper lip is drawn so that the lips appear slightly thinner than what they actually are. The angle between the trough and crests is set to an arbitrary angle within the range of 10 to 15 degrees in accordance with step 5). If the angle is within the range of 10 to 15 degrees, a large difference does not result since the actual amount of adjustment is limited to that on the order of about 1 mm.

Figure 16:
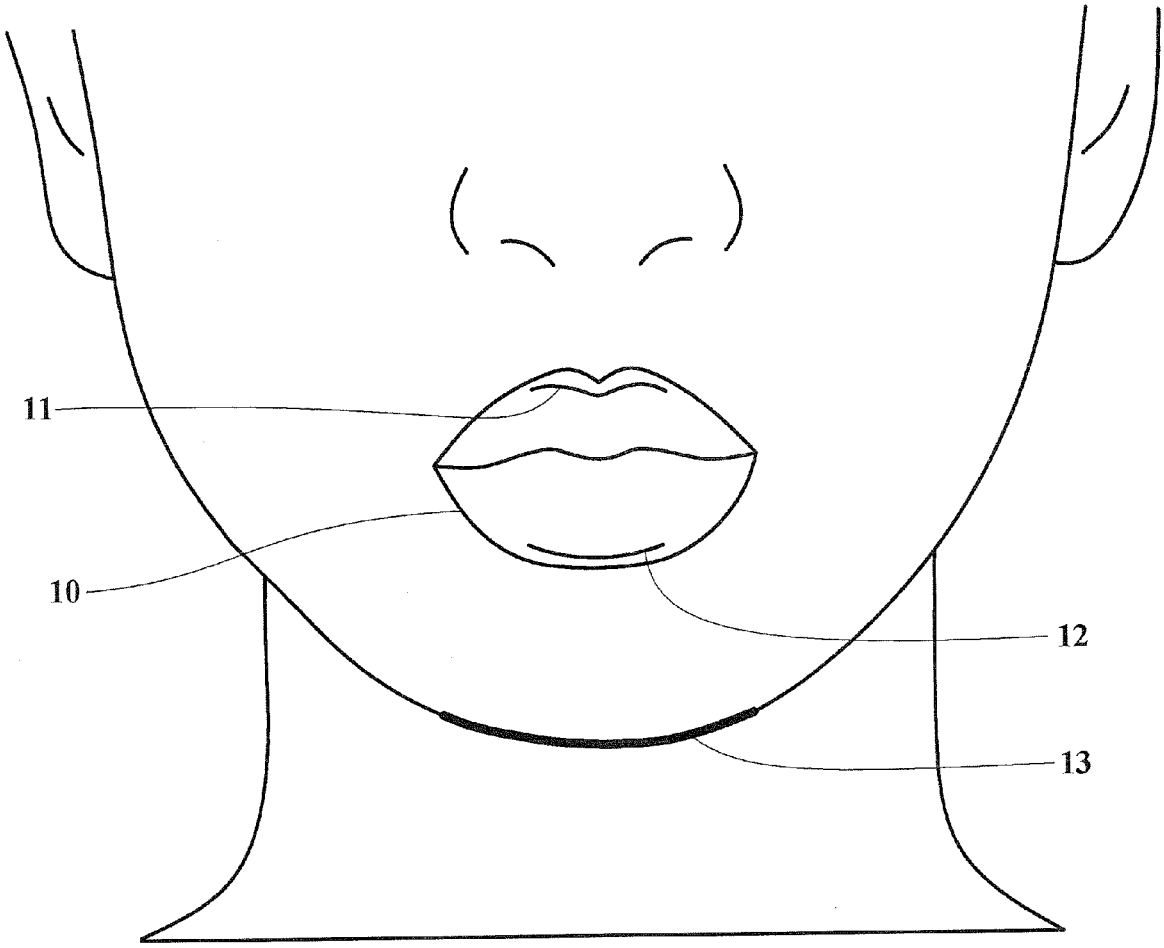
FIG. 16 is a drawing showing the adjusted contour lines of the bottom of the lower lip of a model A.
Figure 17:
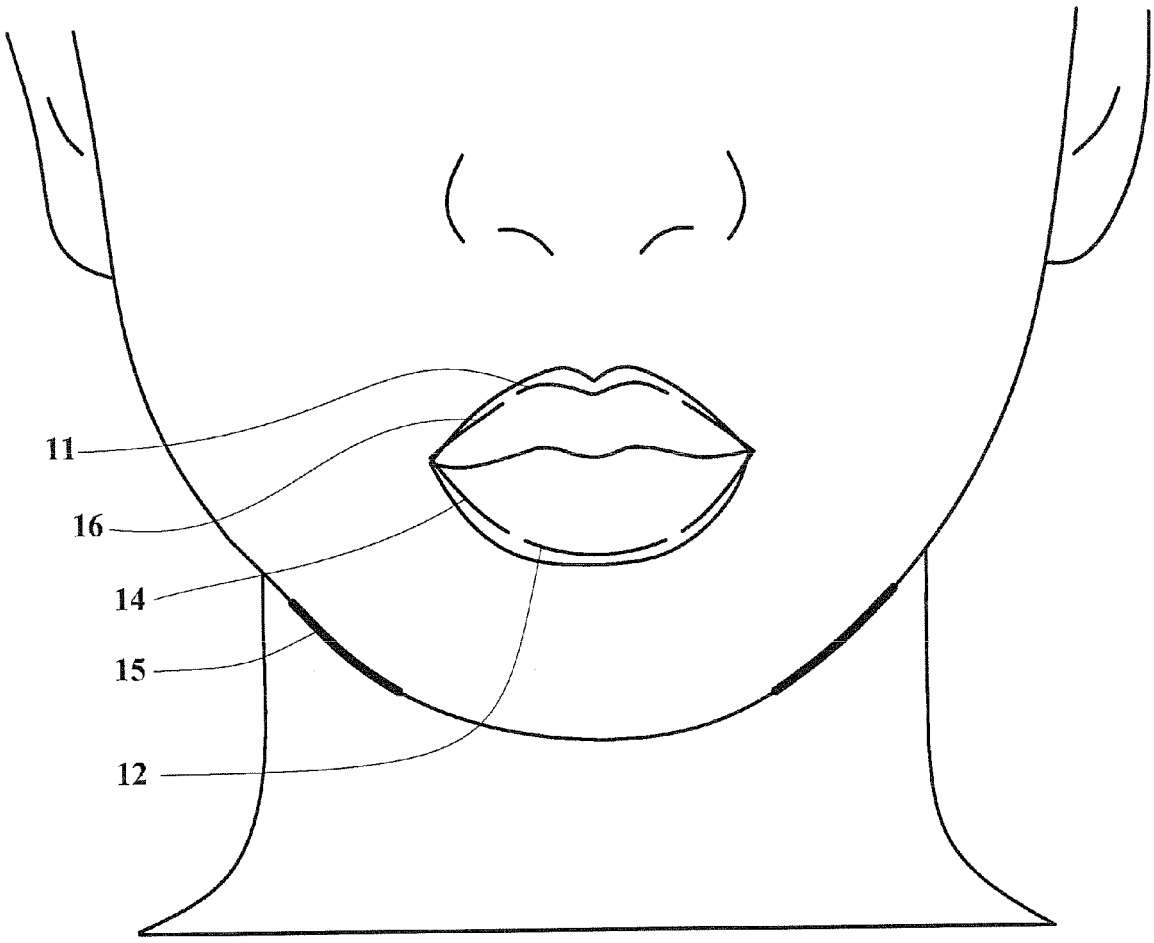
FIG. 17 is a drawing showing the adjusted contour lines for all areas of a model A.
Figure 18:
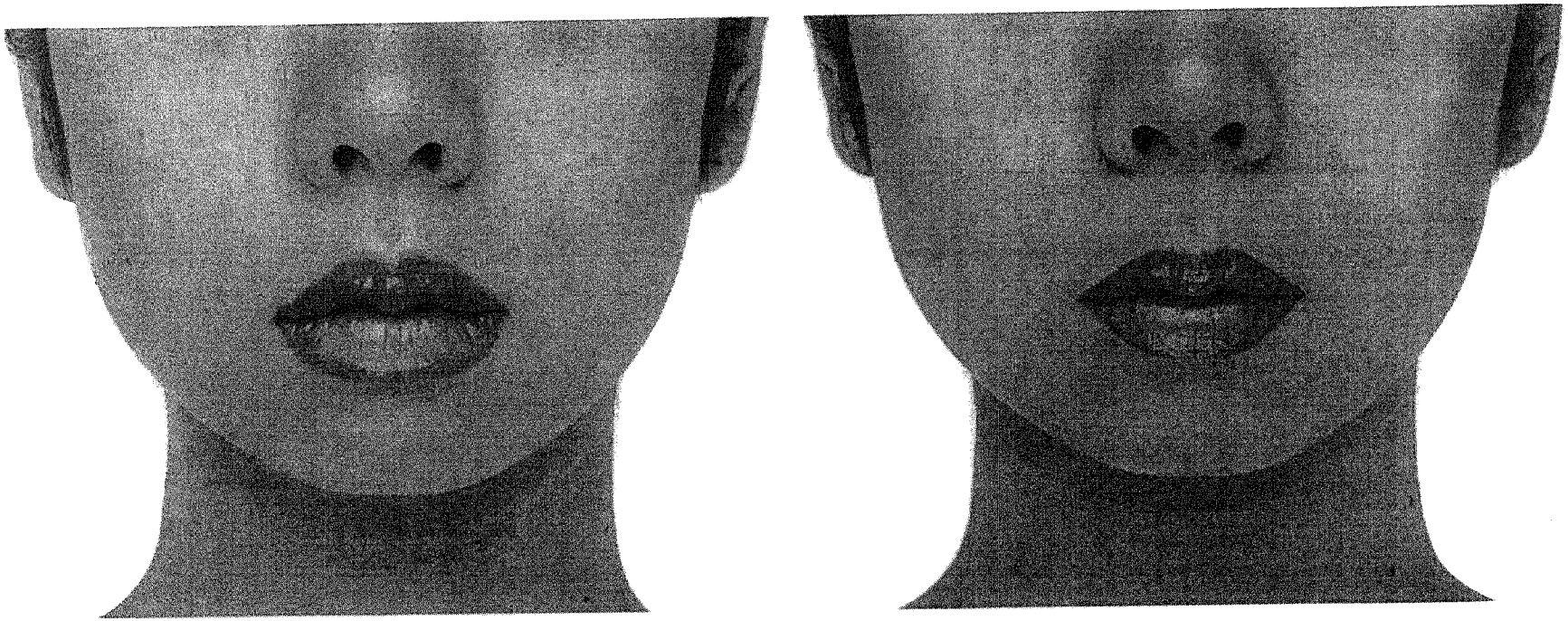
FIG. 18 shows photographs of the lips of a model A before and after adjustment.

Next, with reference to FIG. 16, a line (12) along the bottom of the lower lip is drawn to match a line (13) along the shape of the tip of the jaw in accordance with step 2). At this time, since the lips are thick, the line (12) of the bottom of the lower lip is drawn slightly to the inside. Furthermore, this is adjusted to be within the range of 2 mm in the same manner as the upper lip as previously described. Moreover, as shown in FIG. 17, the shape of the lower lip (14) is drawn nearly in parallel with a jaw line (15) in accordance with step 3), and together with balancing the space between the jaw and lips, a line (16) connecting the corners of the mouth is tightened in accordance with step 4). The drawn lines (11), (12), (14) and (16) obtained in steps 1) to 5) are then smoothly connected to apply makeup. FIG. 18 shows a comparison of lips drawn in accordance with this makeup method (right side) and lips drawn along the inherent form without making adjustments (left side). A comparison of the two reveals that the form of the lips on the right side to which the makeup method of the present invention has been applied can be evaluated as being beautiful, attractive and in the proper balance.

Next, a brief explanation of makeup adjustment points for each type of lip problem used when applying lip makeup as explained above is provided in Table 1.

TABLE 1

| Lip Form | Adjustment Point | After Adjustment |
|---|---|---|
| Excessively thick lips | The height of the crests of the upper lip is drawn 1 to 2 mm lower.<br>Width is added to the mouth by drawing the width between the corners of the mouth 1 to 2 mm longer.<br>The width between the corners of the mouth of the lower lip is tightened by drawing 1 to 2 mm shorter.<br>Vertical wrinkles are made to be inconspicuous. | |
| Excessively thin lips | Both lips are drawn 1 to 2 mm larger without changing the locations of the corners of the mouth.<br>A three-dimensional appearance is enhanced with lip gloss. | |
| Excessively large lips | The distance between the crests of the upper lip is widened.<br>The entire upper lip is drawn 1 to 2 mm smaller without changing the locations of the corners of the mouth.<br>The distance between the corners of the mouth is tightened and drawn to appear straighter. | |
| Excessively small lips | The distance between the crests of the upper lip is widened.<br>Width is added to the mouth by drawing the width between the corners of the mouth 1 to 2 mm longer. | |

TABLE 1-continued

| Lip Form | Adjustment Point | After Adjustment |
|---|---|---|
| | A three-dimensional appearance is enhanced with lip gloss. | |
| Corners of the mouth are excessively low | The distance between the crests of the upper lip is widened. | |
| | Only the crests of the upper lip are drawn lower. | |
| | Width is added to the mouth by drawing the width between the corners of the mouth 1 to 2 mm longer. | |
| | The width between the corners of the mouth of the lower lip is tightened by drawing 1 to 2 mm shorter. | |
| Poorly-defined contour | The distance between the crests of the upper lip is widened. | |
| | The contour of both lips is drawn sharper. | |
| | The distance between the corners of the mouth is tightened and drawn to appear straighter. | |
| Crests of the upper lip are excessively high | The distance between the crests of the upper lip is widened. | |
| | Only the crests of the upper lip are drawn lower without changing the locations of the corners of the mouth. | |
| | The distance between the corners of the mouth is tightened and drawn to be rising upward. | |

Makeup Assistance Tool

Figure 19:
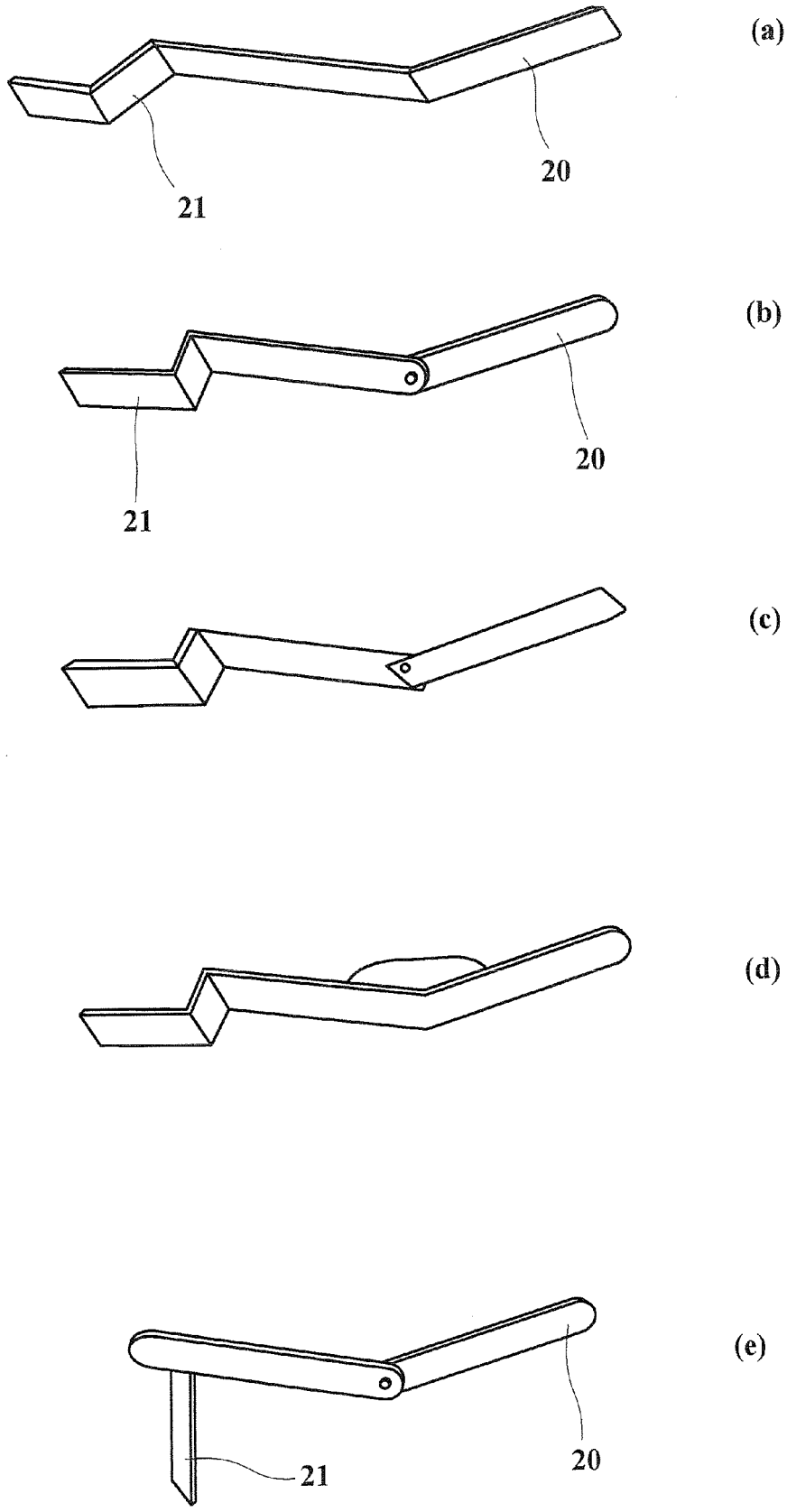
FIG. 19(*a*)-(*e*) are drawings showing examples of upper lip tools.
Figure 20:
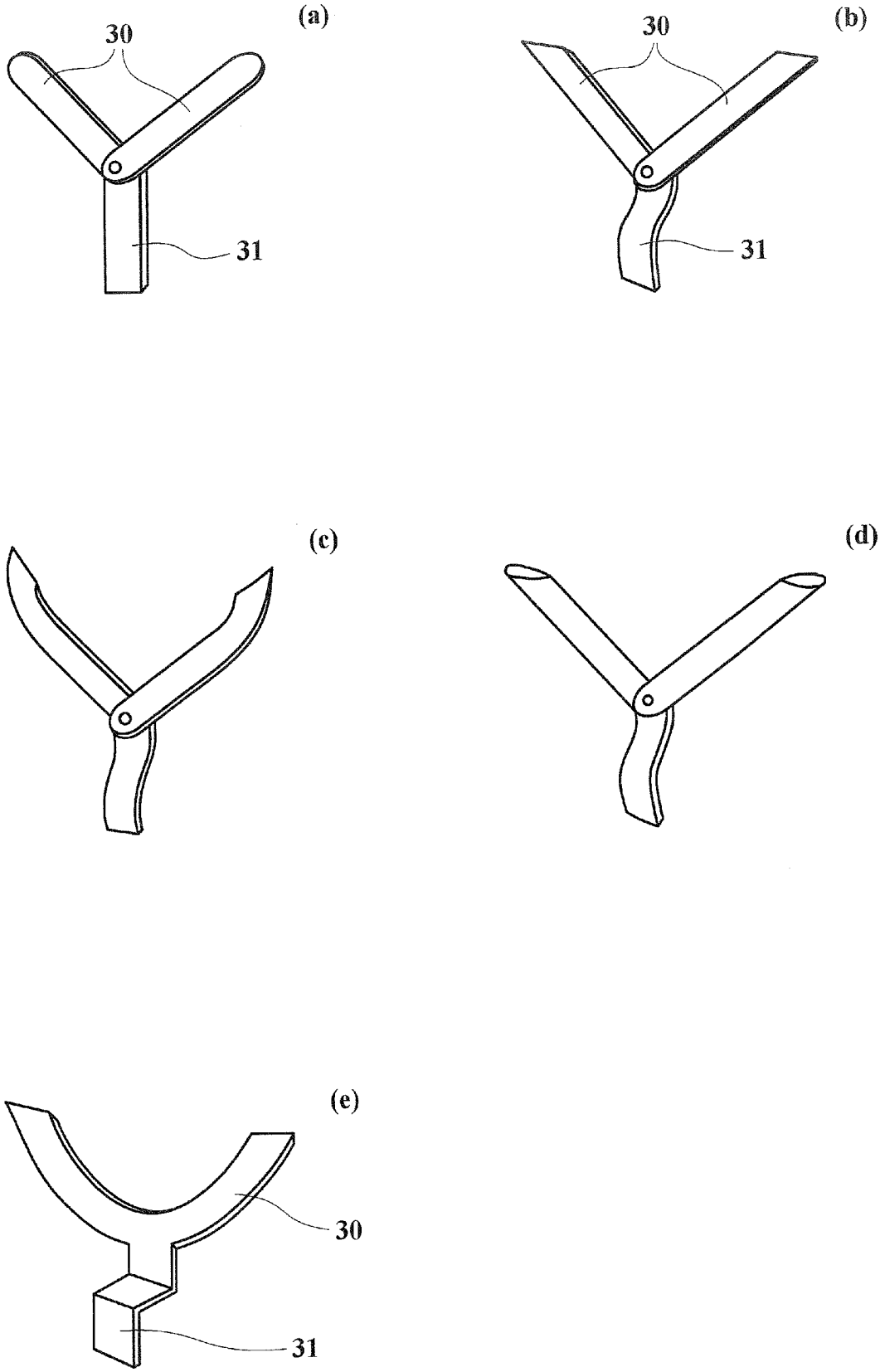
FIG. 20(*a*)-(*e*) are drawings showing examples of lower lip tools.

FIGS. 19 and 20 show auxiliary makeup assistance tools preferably used when applying makeup to the lips as described above. As was previously described, the angle between the trough and crests of the upper lip is preferably within the range of 10 to 15 degrees, and that angle is selected corresponding to the form of the lips as indicated in Table 1 above. In addition, the shape of both sides of the lower lip is required to be drawn nearly parallel with the jaw line. The makeup assistance tool shown in the drawings is a preferable tool for drawing the angle between the trough and crests of the upper lip and for drawing the shape of both sides of the lower lip to be nearly parallel with the jaw line. FIG. 19 shows upper lip tools for drawing the angle between the trough and crests of the upper lip, and is composed of a scale (20) and a handle (21). The scale (20) is composed of a V-shaped plate-like member capable of adjusting the angle within the range of 10 to 15 degrees, and the handle (21) is a plate-like member integrally coupled to one end of the scale (20). Although there are no particular limitations on the material or thickness and so on, the tool is formed with, for example, a 0.2 to 0.4 mm acrylic plastic or shape-retaining material. The scale (20) and handle (21) preferably have different colors. At the time of use, the apices of the crests of the upper lip are set at positions below the center of the nostrils and marks are made with a lip pencil and the like. The center of the V-shaped scale is then aligned with the bottom of the trough, lines are drawn from the marks with a lip pencil or red pencil to draw lines from the trough to the apices of the crests. Contour lines of the upper lip are then drawn by connecting the corners of the mouth with the crest marks.

The tool shown in FIG. 19A is composed with a bendable plate-like member and allows the angle to be arbitrarily adjusted. The tool of FIG. 19B allows the angle to be adjusted as desired by connecting the scale with a hinge. The tool of FIG. 19C employs a triangular cross-section for the scale. The tool of FIG. 19D facilitates confirmation of the angle by contacting a central protrusion with the upper portion of the lip. The tool of FIG. 19E has the handle (21) perpendicularly attached to one end of the scale (20).

FIG. 20 shows lower lip tools for drawing the shape of both sides of the lower lip to be parallel with the jaw line, and is composed of a scale (30) and a handle (31), with the handle (31) having a Y-shape and attached to the center of the scale (30). Although the scale (30) is preferably hinged to enable the angle to be arbitrarily changed as desired, but the change in angle is not an essential requirement. It may also have a fixed shape as shown in FIG. 20E. Although the material and thickness are preferably such that the tool is composed of, for example, a 0.2 to 0.4 mm acrylic plastic or shape-retaining material in the same manner as the previously described upper lip tools, there are no particular limitations thereon. At the time of use, the angle of the scale (30) is aligned with the shape of the jaw line while aligning the scale (30) with the corners of the lower lip. A line is then drawn along the scale with a lip pencil or red pencil, and then connected with the bottom of the lower lip while giving a natural roundness. The bottom of the lower lip is preferably drawn slightly longer than the width between the crests of the upper lip while having nearly the same shape as the shape of the jaw line.

Use of the tools shown in FIGS. 19 and 20 makes it possible to easily and reliably draw the shape of the crests and trough of the upper lip as well as the shape extending from both sides of the lower lips to the corners of the mouth, which are the most important points of the upper and lower lips, while looking in a mirror.

The following provides a detailed explanation of another preferred embodiment of the present invention. This embodiment provides makeup information for a preferably balanced form by using the previously described method for categorizing the formal features of the lips, photographing the lips of a subject to which makeup is to be applied, incorporating both images in a computer, two-dimensionally and three-dimensionally analyzing the form of the lips while displaying on a screen, judging the formal features of the lips of the subject based on the analyzed information, and giving the judged form a preferable balance. The two-dimensional analysis is carried out by measuring the locations of a plurality of preset points. Three-dimensional analysis is carried out by judging the three-dimensional appearance of the lips, namely the thickness of the lips as to whether or not they are full, and adjusting the visual perception of the thickness of the lips when applying makeup, and is judged by measuring the amount of change in the brightness value of the lips on a screen.

In the standard lip proportions shown in the previously described FIGS. 1 and 2, lip proportions are numerically characterized by using the position of the mouth, width of the mouth, and standard features of the lips as indices. Namely, in the drawings, the position of the lips is defined as the position (c) where the bottom line of the lower lip is located at one-half the length from the wings of the nose (a) to the tip of the jaw (b), and the width of the mouth is defined as the position where both ends of the lips are located where vertical lines extend vertically downward from the insides of the irises of both eyes. In addition, in the case of standard lips, the crests of the lip are defined as being located at three-fourths the distance from a corner of the mouth to the center of the lips, and the ratio of the thickness of the upper lip to the lower lip is defined as being 1:1.5.

However, in making up lips based on these standard proportions, it is difficult to propose makeup corresponding to individual lips. In addition, these standard proportions were generated more than twenty years ago, and not only facial proportions, but also the forms of the lips and jaw have changed over time accompanying considerable changes in dietary habits. Consequently, they may not be suitable for making up lips of modern women. For example, when compared with the lips of women twenty years ago, the form of the lips of modern 20-year-old women are such that the width of the mouth is smaller, the ratio between the upper and lower lips is closer, and the lips have a thicker, fuller image, thus differing from the standard proportions described above. In addition, conventional standard lip proportions used only four elements as indices, namely the position of the mouth, the width of the mouth, the position of the crests of the upper lip and the ratio of the thicknesses of the upper and lower lips, and this number of elements is considered to be too few and general for determining lip proportions.

As was previously described in relation to FIGS. 1 and 2, although the ratio of the upper and lower lips in the conventional standard proportions was 1:1.5, since the lips of modern women are such that the lips have a curved sense, the crests of the upper lip are rounded and the lips have a three-dimensionally full image, there is the possibility that the ratio of the upper and lower lips is also changing. Therefore, when the dimensions of the upper and lower lips of 50 of the modern women were measured, calculation of the average value thereof yielded a ratio of 1:1.3 to 1:1.43. Namely, the ratio had changed from the conventional ratio of the upper and lower lips of 1:1.5. However, since there is an adequate basis for the conventional ratio and can be understood to be a ratio that is adequately applied to modern women as well, the ratio of the upper and lower lips can be said to be within the range of 1:1.3 to 1:1.5. Thus, in the case of applying makeup to the lips, if the lips are made up so as to be within this range, they can be considered to be able to be evaluated as having balance between the upper and lower lips.

In this embodiment, values characterizing proportions were altered slightly prior to use while using the ratio of the upper and lower lips based on the proportions of the lips of modern women evaluated as being attractive as previously described. Namely, in the analysis technique for lip proportions according to the previous invention, although proportions were analyzed based on the positions of the crests of the upper lip and the center of the lower edge of the lower lip, there is the risk of such judgments of lip position being unclear in the case of using images taken of a subject. Therefore, the center of the upper and lower lips was used as a criterion for proportion recognition, and proportions were analyzed based on this center. Furthermore, if some form of correction technique is employed for confirmation of the reference positions, the conventional proportion analysis technique shown in FIG. 1 may naturally be employed.

Figure 21:
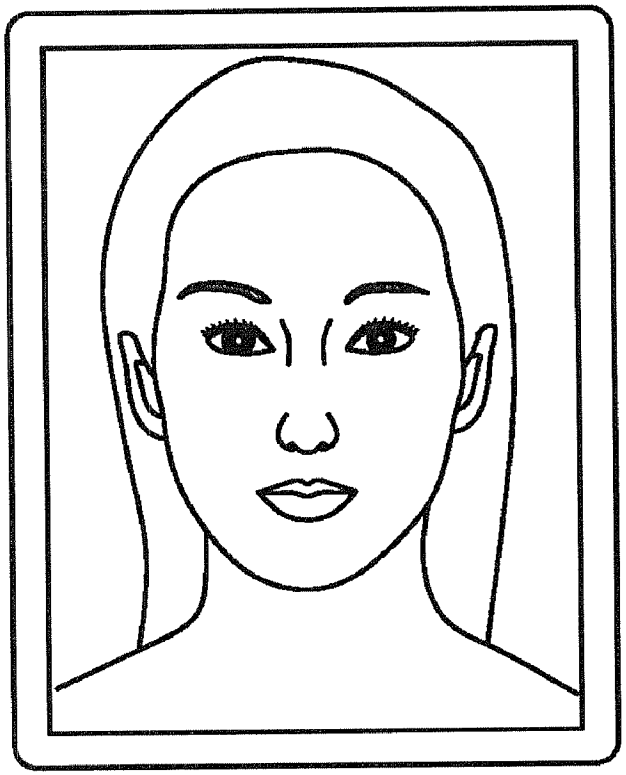
FIG. 21 is a drawing showing a facial image of a subject.
Figure 21:
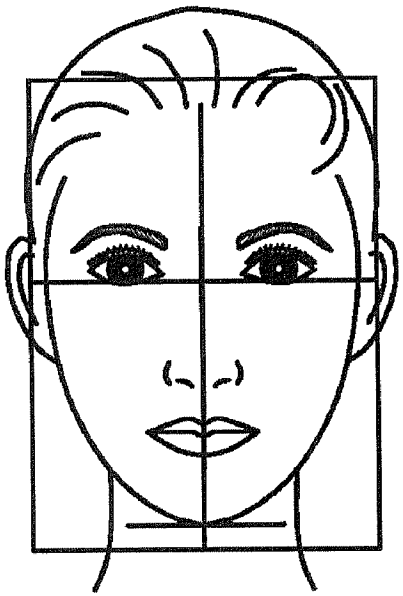
Figure 22:
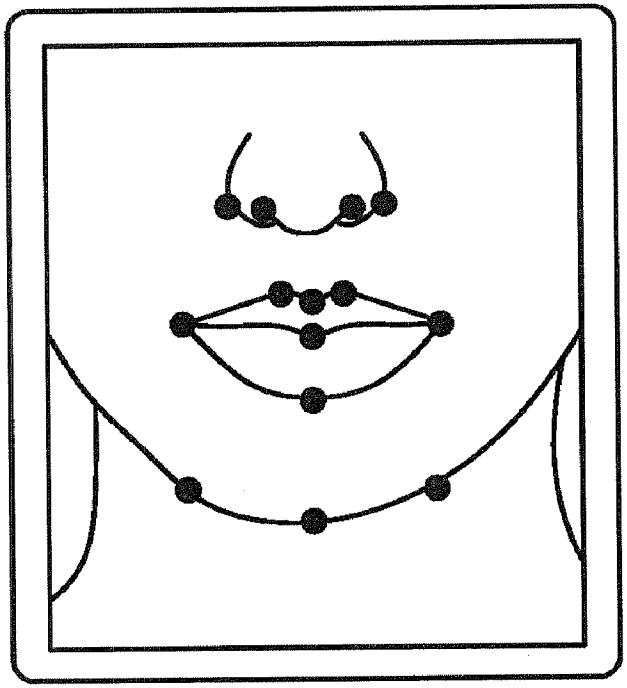
FIG. 22 is a drawing showing an enlarged image of the lips and points of two-dimensional analysis.
Figure 22:
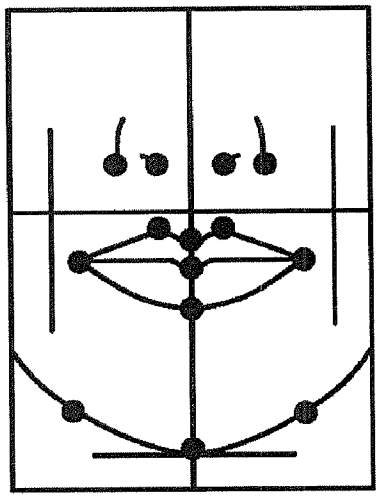

The following provides a sequential explanation of specific means for carrying out two-dimensional and three-dimensional analyses of lip proportions, a judgment method and generation of makeup information with reference to FIGS. 21 to 31. With reference to FIG. 21, the position of the lips is determined by referring to the illustration of the face displayed on the left side of the drawing, a photograph is taken of the face, and image information is incorporated and accumulated in a computer. The positions of a plurality of preset points for determining formal features of the lips are then measured from the incorporated image of the face. In this embodiment, as shown in FIG. 22, the number of points is set to the following 14 points: namely, the positions of both sides of the nose (2 points), the positions of the centers of the nostrils (2 points), the positions of the crests of the upper lip (2 points), the position of the trough of the upper lip, the center of the lips, the positions of the corners of the mouth (2 points), the center of the lower edge of the lower lip, the center of the jaw and the positions of both sides of the jaw (2 points) for a total of 14 points. Furthermore, there are no particular limitations on the positions and number of these points, and the positions and number can be suitably changed provided they enable the formal features of the lips to be determined and are suitable for generating makeup information.

In the generation of makeup information, a photograph is taken of a subject's face, the accumulated image information is used to measure the positions of these 14 points specifying lip proportions on the image, and the two-dimensional formal features of the lips are analyzed. Measurement of the positions of these points is preferably carried out automatically by computer, and adjustments to the positions can be made manually if the positions of the points have shifted. The two-dimensional features analyzed by measuring the positions of the 14 points are then judged for the following five parameters to determine the overall balance of the subject's lips. The determined balance of the subject's lips is compared with a standard optimum balance, that difference is measured, a makeup method that corrects those portions that differ from the standard is displayed on a screen in the form of makeup information, and that makeup information is provided to the subject. The standard lip balance is dependent on the lip proportions evaluated as being attractive determined by the lip categorizing method of the previously described invention.

Figure 23:
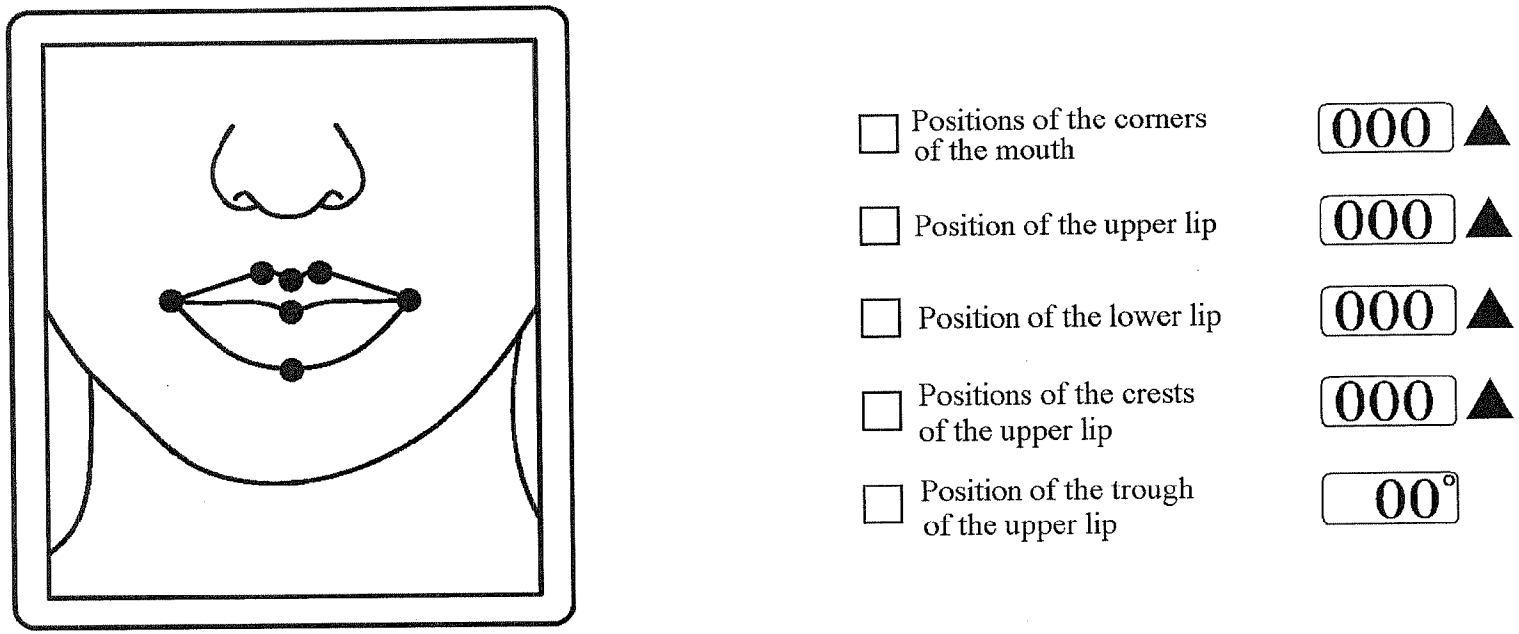
FIG. 23 is a screen showing the results of two-dimensional analysis.

The five parameters used to judge formal balance of the lips are comprised of the positions of the corners of the mouth, the position of the upper lip, the position of the lower lip, the positions of the crests of the upper lip and the angle between the crests and trough of the upper lip. With reference to FIG. 23, the criteria of the five parameters for optimum balance are comprised of the positions along lines extending vertically downward from the inside of the irises for the positions of the corners of the mouth, the position one-third the distance from the oral slit to beneath the nose for the position of the upper lip, the position one-third the distance from the oral slit to the position of the jaw for the position of the lower lip, the positions below the center of the nostrils for the positions of the crests of the upper lip, and the position 10 degrees downward from the crests to the trough of the upper lip for the angle between the crests and trough of the upper lip.

Figure 24:
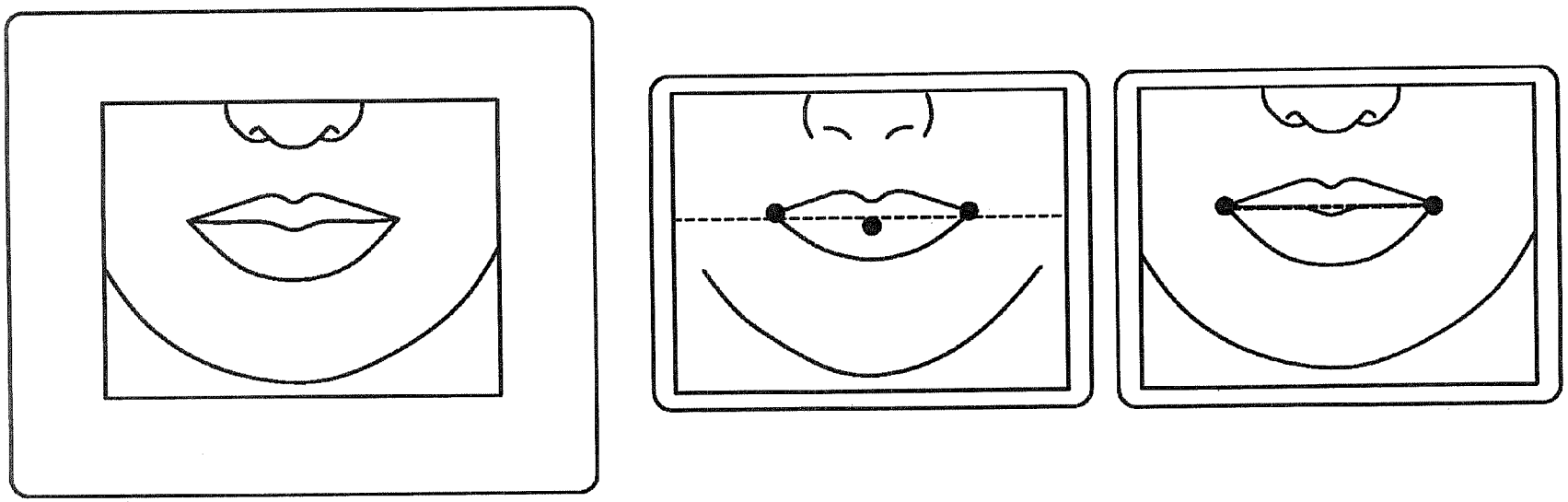
FIG. 24 are screens showing positional correction of a customer based on the results of two-dimensional analysis.

The balance of the lips to be made up is compared with the optimum standard lip balance, differences between the two are determined, and corrective makeup information is generated and displayed on a screen for correcting the target lips to the standard balance. The following provides an explanation of the correction technique with reference to the drawings. First, with reference to FIG. 24 showing a method for determining the positions of the corners of the mouth, a horizontal line is drawn from the center of the lips, and a measurement is made as to whether the positions of the corners of the mouth are above or below the horizontal line. If the positions of the corners of the mouth are above the horizontal line, no particular corrections are made. If they are below the horizontal line, since the lips appear to be weak and lax, corrective makeup is applied so as to correct the positions of the corners of the mouth upward by no more than 2 mm. The reason for making the limit of adjustment 2 mm is to avoid the result of adjustment appearing unnatural, and in the case of a beauty consultant providing lip makeup advice to customers at a store and proposing a makeup method that approaches the standard lips, the amount of change is normally within the range of about 2 mm. If the correction range exceeds 2 mm, the corrected width appears too large and makeup appears unnatural thereby making this undesirable. Furthermore, in the case the initial points for the positions of the corners of the mouth have shifted, since this means that the points for the optimum balance will have also shifted, the points for the corners of the mouth are adjusted manually. The correction range of 2 mm applies to other areas as well.

Figure 25:
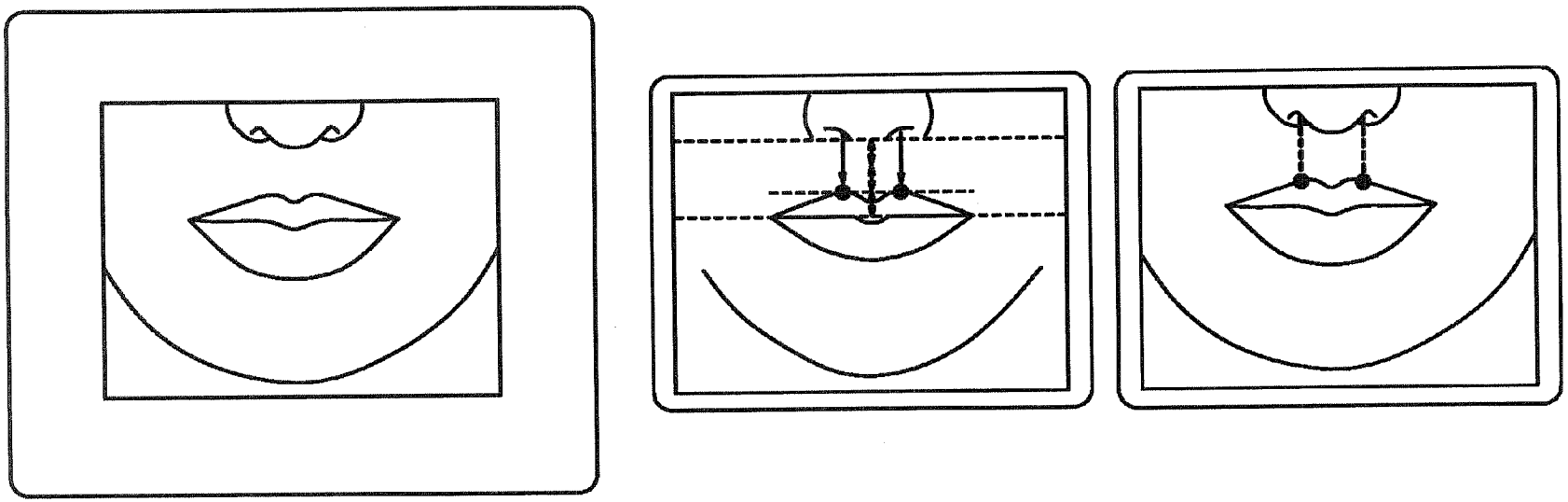
FIG. 25 are screens for determining the position of the crests of the upper lip.
Figure 26:
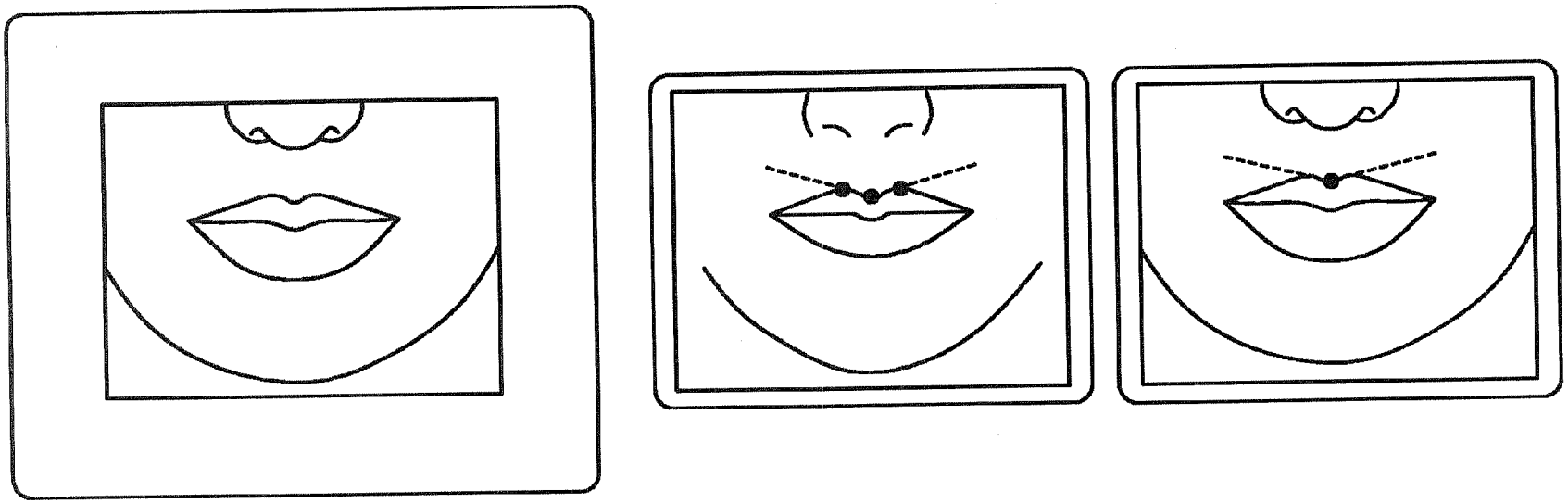
FIG. 26 are screens for determining the position of the trough of the upper lip.
Figure 27:
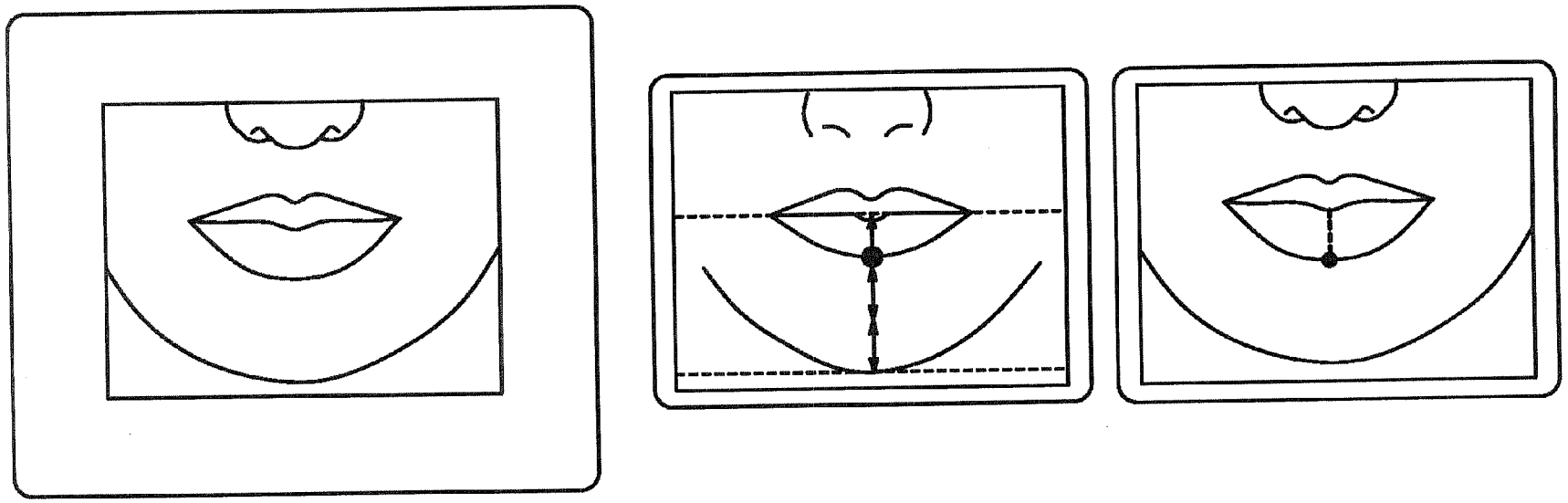
FIG. 27 are screens for determining the position of the lower lip.
Figure 28:
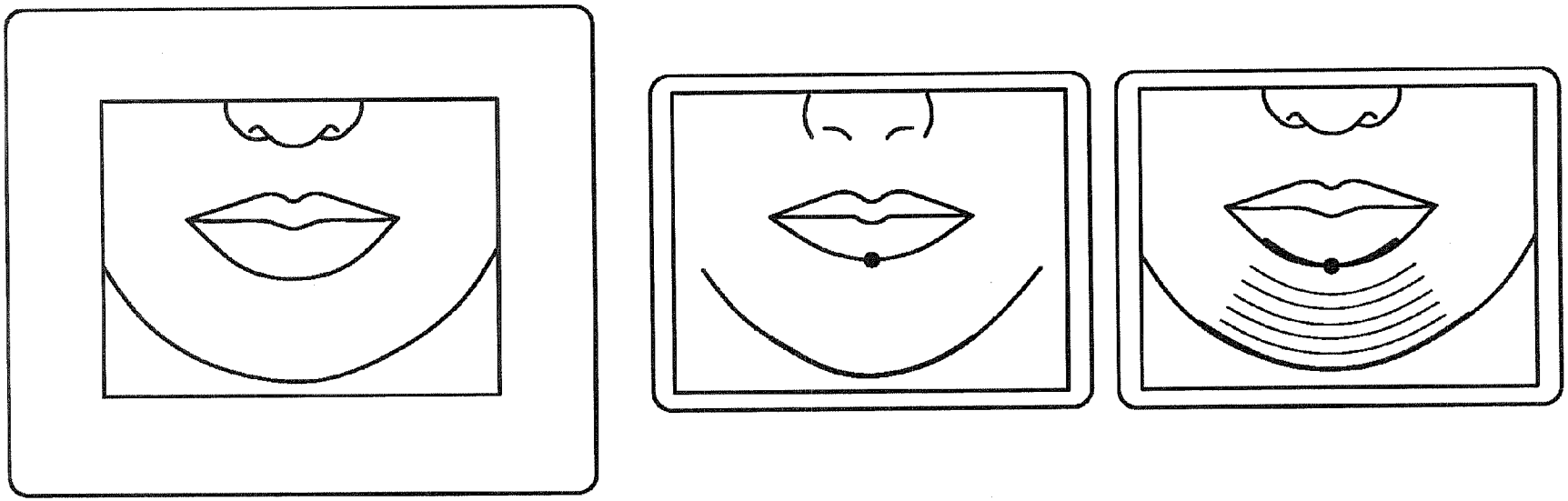
FIG. 28 are screens for determining the line of the lower lip.

Next, the shapes of the crests and trough of the upper lip are corrected. With reference to FIG. 25, the position of the crests of the upper lip are set to positions determined based on the criterion of the positions one-third the distance from the oral slit to beneath the nose and the positions on a vertical line extending downward from the center of the nostrils, and makeup points are set on the screen so that the crests of the upper lip lie at the determined positions. Next, as shown in FIG. 26, the position of the trough of the upper lip is set based on the criterion of an angle extending downward at 10 degrees from the crests toward the trough. Although this angle was defined to be within the range of 10 to 15 degrees in the previous invention, in the present embodiment, it is preset to 10 degrees. However, this angle is not limited to 10 degrees, but rather can be set arbitrarily within the range of 10 to 15 degrees. Next, as shown in FIG. 27, the position of the lower lip is set at a position one-third the distance from the oral slit to the position of the jaw, and as shown in FIG. 28, the center position of the jaw line and the positions of three points on both sides thereof are connected in the form of arcs, and the line of lower lip is drawn in a shape that resembles the shape of the arcs of the lower jaw. Although a scale tool for drawing these arcs may be provided for drawing this lower jaw line, it can also be drawn automatically on a computer screen by altering the basic form so as to follow the lower jaw line.

Figure 29:
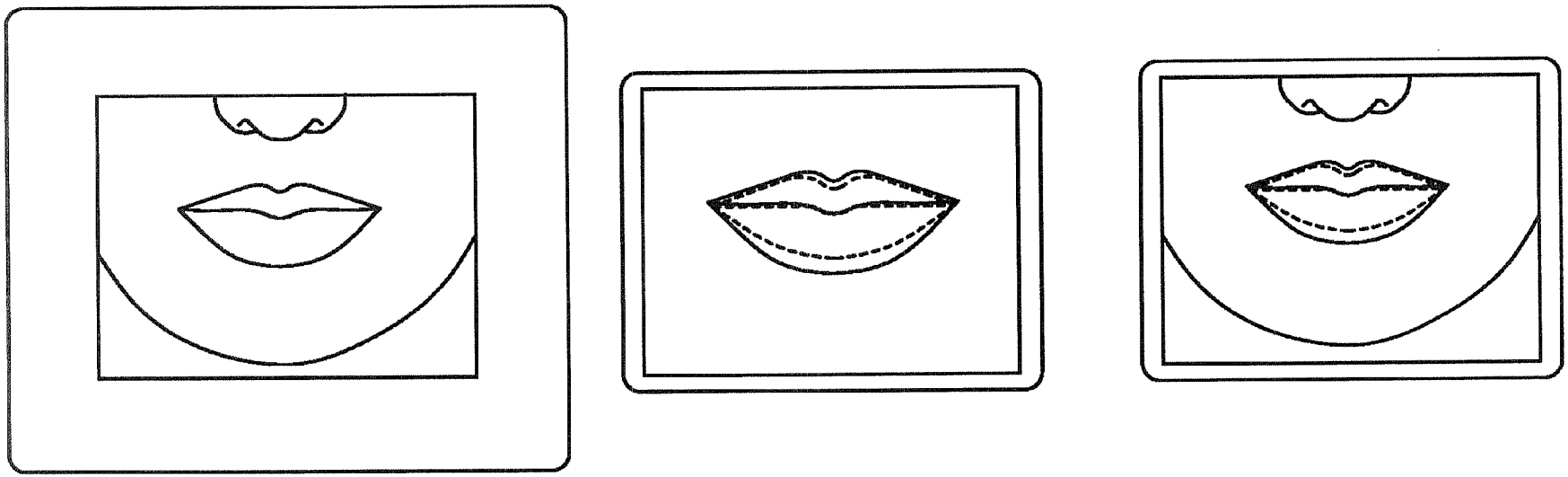
FIG. 29 are screens showing the outline of the lips of a subject as determined by two-dimensional analysis and the corrected makeup outline.

In this manner, lines are determined for correcting the overall balance of the lips of a subject to the optimum balance as shown in FIG. 29 by comparing with the optimum balance based on the criteria of five parameters to determine the difference there between. FIG. 29 shows the formal contour lines of the lips of a subject, and the dotted lines indicate the form of the optimum balance as corrected based on the above-mentioned criteria. The outlines indicated with dotted lines indicate the optimum formal balance, and as a result of a beauty consultant providing advice on makeup methods to achieve the optimum balance for the lips based on a computer screen, a subject is able to apply makeup so that the lips appear attractive and in the proper form by drawing the lips while following the corrected lines.

Figure 30:
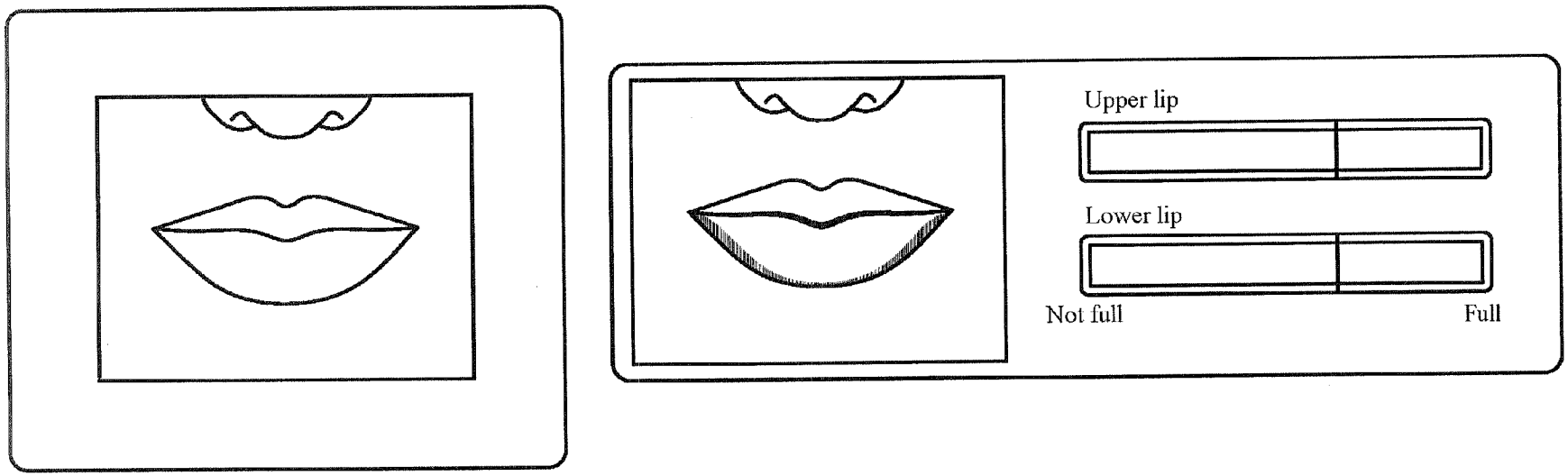
FIG. 30 are screens showing a three-dimensional analysis.

FIG. 30 indicates a judgment of lip thickness by three-dimensional analysis of the lips and proposes a correction method. With reference to FIG. 30, lip thickness, namely, three-dimensional analysis is used to make a judgment according to differences in brightness values on a screen between the center of the lips and the corners of the mouth. A three-dimensional judgment is made when a difference is present, while a two-dimensional judgment is made in the absence of a difference. As shown in FIG. 30, an enlarged image of the lips is displayed on a screen, and by pressing an analysis button, the image changes to a facial moiré photograph in which differences in brightness values are distinctly displayed together with a map of those differences. By using this three-dimensional analysis image, a beauty consultant explains the three-dimensional proportions of the lips of a subject and propose a makeup method. For example, in the case the lips of a subject have a three-dimensional appearance, a makeup method is proposed in which the outlines are drawn narrower to reduce the three-dimensional appearance, while conversely in the case the lips appear to be two-dimensional, a makeup method is proposed in which the outlines are drawn thicker to emphasize a three-dimensional appearance. Moreover, corrections are made by changing the color used to draw the bright areas of the lips and the color brightness of the lip gloss used to add gloss to the lips.

Figure 31:
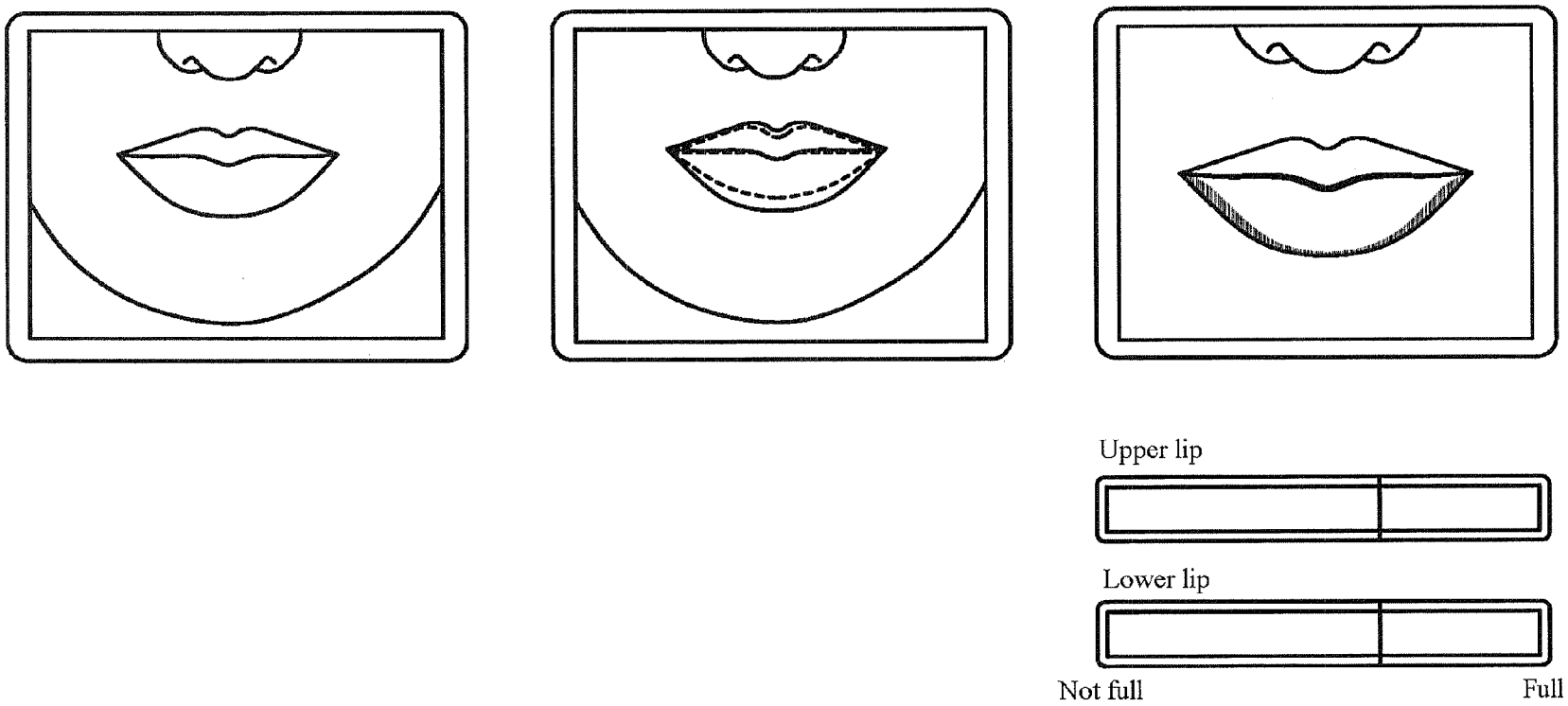
FIG. 31 are parallel screens showing an enlarged photograph of the lips of a subject, a two-dimensionally corrected makeup outline, and the three-dimensional appearance of the lips.

FIG. 31 shows a screen on which are arranged an enlarged photograph of the lips of a subject, a corrective makeup screen proposed on the basis of the two-dimensional analysis as previously described, and a screen displaying the three-dimensional appearance of the lips. A beauty consultant is able to propose the optimum corrective makeup method while referring to these screens, and the subject is able to visually confirm the two-dimensional and three-dimensional features of the subject's own lips along with the effects of the proposed corrective makeup by viewing this screen.

What is claimed is:

1. A lip categorizing method comprising: categorizing lips using the size and shape of lips as viewed from the front of a face as a first categorization index and using the three-dimensional form of the lips as a second categorization index, in order to enable determination of a form image of the lips, wherein the first categorization index includes as indices at least the lateral width of the lips, the form of the crests and trough of the lips, and the form of the bottom of the lower lip, while the second categorization index includes as indices at least whether the contour shape of the lips is linear or curved, and the three-dimensional form of the lips.

2. A lip categorizing map comprising: a first coordinate axis showing the degree of a first categorization index using as indices the size and shape of the lips as viewed from the front of the face; and a second coordinate axis showing the degree of a second categorization index using as indices the three-dimensional form of the lips, the determination of a form image of the lips being allowed by composing a coordinate system in which the first and second coordinate axes are orthogonal.

3. The lip categorizing map according to claim 2, wherein lips having a standard form are located in the center of the coordinate system.

4. The lip categorizing map according to claim 2, wherein the first categorization index includes as indices at least the lateral width of the lips, the form of the crests and trough of the lips, and the form of the bottom of the lower lip, while the second categorization index includes as indices at least whether the contour shape of the lips is linear or curved, and the three-dimensional form of the lips.

5. A lip makeup method comprising: generating makeup information for two-dimensionally correcting the lips of a subject based on preset reference by setting a plurality of points for determining the form features of lips on an image depicting the lips, and judging the form features of the lips of the subject based on analytical values of the two-dimensional features of the lips measured from the set points.

wherein in addition to analysis of two-dimensional features of the lips, the three-dimensional appearance of the lips is determine by analyzing three-dimensional features of the lips according to brightness values of the image.

6. The makeup method according to claim 5, wherein the points used to determine form features of the lips comprise the position of the nose, the center positions of the nostrils, the positions of the crests and trough of the upper lip, the center position of the lips, the positions of the corners of the mouth, the center position of the lower lip, and the position of the jaw.

7. The lip makeup method according to claim 5, wherein the reference for generating makeup information for two-dimensionally correcting the lips comprise the five parameters indicated below:

parameter 1: reference for indicating the positions of the corners of the mouth;

parameter 2: reference for indicating the position of the upper lip;

parameter 3: reference for indicating the position of the lower lip;

parameter 4: reference for indicating the positions of the crests of the upper lip; and parameter 5: reference for indicating the position of the trough of the upper lip.

8. The makeup method according to claim 6, wherein the reference for indicating the positions of the corners of the mouth is defined as the positions determined based on the center of the lips.

9. The makeup method according to claim 6, wherein the reference for indicating the position of the upper lip is defined as the position one-third the distance from an oral slit to beneath the nose.

10. The makeup method according to claim 6, wherein the reference for indicating the position of the lower lip is defined as the position one-third the distance from an oral slit to the position of the jaw.

11. The makeup method according to claim 6, wherein the reference for indicating the positions of the crests of the upper lip is defined as the positions below the center of the nostrils.

12. The makeup method according to claim 6, wherein the reference for indicating the position of the trough of the upper lip is defined as the position 10 degrees downward from the crests towards the trough.

13. The makeup method according to claim 5, wherein the inherent outline of the lips and an outline of two-dimensionally corrected makeup information related to the lips of a subject are simultaneously displayed on an image of the lips of the subject.

* * * * *